US011309623B2

(12) United States Patent
Saito et al.

(10) Patent No.: US 11,309,623 B2
(45) Date of Patent: Apr. 19, 2022

(54) ANTENNA DEVICE

(71) Applicants: Japan Aerospace Exploration Agency, Tokyo (JP); TOKYO INSTITUTE OF TECHNOLOGY, Tokyo (JP)

(72) Inventors: Hirobumi Saito, Tokyo (JP); Budhaditya Pyne, Tokyo (JP); Jiro Hirokawa, Tokyo (JP)

(73) Assignees: JAPAN AEROSPACE EXPLORATION AGENCY; TOKYO INSTITUTE OF TECHNOLOGY

( * ) Notice: Subject to any disclaimer, the term of this patent is extended or adjusted under 35 U.S.C. 154(b) by 92 days.

(21) Appl. No.: 16/822,457

(22) Filed: Mar. 18, 2020

(65) Prior Publication Data

US 2020/0303811 A1 Sep. 24, 2020

(30) Foreign Application Priority Data

Mar. 18, 2019 (JP) ..... JP2019-050433

(51) Int. Cl.
*H01Q 1/28* (2006.01)
*H01Q 21/00* (2006.01)
(Continued)

(52) U.S. Cl.
CPC ..... *H01Q 1/288* (2013.01); *H01Q 1/08* (2013.01); *H01Q 13/0266* (2013.01); *H01Q 21/0006* (2013.01); *H01Q 21/061* (2013.01)

(58) Field of Classification Search
CPC .... H01Q 21/0006; H01Q 21/061; H01Q 1/08; H01Q 1/288; H01Q 13/0266
See application file for complete search history.

(56) References Cited

U.S. PATENT DOCUMENTS

2018/0309179 A1* 10/2018 Mizutani ..... H01P 1/213

FOREIGN PATENT DOCUMENTS

JP 2012-090253 A 5/2012

OTHER PUBLICATIONS

Toru Takahashi, The Institute of Electronics, Information and Communication Engineers "Forest of Knowledge," 4 group (communications engineering) 2nd edition (antennas and propagation), Chapter 7 Array antennas, 7-4 Array antenna feed circuits, [online], 2013, IEICE, 19 pages, [retrieved on Nov. 23, 2018], Internet<URL:http://www.ieice-hbkb.org/files/04/04gun_02hen_07.pdf#page=15>; (with partial English translation).

(Continued)

*Primary Examiner* — Daniel Munoz
(74) *Attorney, Agent, or Firm* — Ostrolenk Faber LLP

(57) ABSTRACT

An antenna device includes: an antenna panel; one input terminal through which a high-frequency signal is input; and a feeding circuit which distributes the high-frequency signal input to the input terminal to a plurality of antenna elements provided on the antenna panel. The feeding circuit includes: at least one first-stage branch circuit which includes one input and two outputs; at least two second-stage branch circuits which receive outputs of the first-stage branch circuit and include one input and two outputs; and a combining circuit which includes two inputs and one output and receives two outputs selected from the outputs of the first-stage branch circuit and outputs of the second-stage branch circuit.

6 Claims, 9 Drawing Sheets

(51) Int. Cl.

| | |
|---|---|
| ***H01Q 21/06*** | (2006.01) |
| ***H01Q 1/08*** | (2006.01) |
| ***H01Q 13/02*** | (2006.01) |

(56) References Cited

OTHER PUBLICATIONS

Prilando Rizki Akbar et al., "Parallel-Plate Slot Array Antenna for Deployable SAR Antenna onboard Small Satellite," IEEE Trans on Antennas and Propagation, vol. 64, No. 5, May 2016, 12 pages.
Budhaditya Pyne et al., "Slot-Array Antenna Feeder Network for Space-Borne X-Band Synthetic Aperture Radar," IEEE Trans on Antennas and Propagation, vol. 66, No. 7, Jul. 2018, pp. 3463-3474.

* cited by examiner

ANTENNA DEVICE

BACKGROUND OF THE INVENTION

Field of the Invention

The present invention is an antenna device.

Priority is claimed on Japanese Patent Application No. 2019-050433, filed Mar. 18, 2019, the content of which is incorporated herein by reference.

Description of Related Art

There is a case in which a deployable phased array antenna is mounted on an artificial satellite as a deployable antenna device (for example, refer to Japanese Unexamined Patent Application, First Publication No. 2012-90253, which is hereinafter referred to as Patent Document 1). The deployable phased array antenna disclosed in Patent Document 1 includes a hinge which connects adjacent panels. The hinge has, for example, a degree of freedom of rotation of 90 degrees or 180 degrees.

In general antenna devices, passive array antennas are used in addition to active array antennas.

Generally, in a passive array antenna which requires a wide operating frequency range (broadband), a high-frequency phase to each of antenna elements must be uniform in a wide frequency range, and a parallel feeding method in which high-frequency signal is supplied in parallel from a signal source to each of the antenna elements with the same electrical length is used (for example, refer to Takahashi Tom, "The Institute of Electronics, Information and Communication Engineers (IEICE), [Knowledge Base], Group 4 (Communications Engineering), 2nd edition (Antennas and Propagation), Chapter 7 Array antennas, 7-4, Feeding circuits for array antenna", [online], 2013, IEICE, [found on Nov. 23, 2018], Internet URL:http://www.ieice-hbkb.org/files/04/04gun_02hen_07.pdf#page=15). A 3-terminal circuit of one-input and two-output in which circuits and wiring are easily installed is used for dividing a signal from the signal source to the antenna elements. Thus, a parallel feeding circuit is a tournament type, and the number of antenna elements is $2^k$ (k is the number of layers of tournament, a natural number).

In addition, a method of feeding high-frequency signal to a deployment structure has been disclosed.

The high-frequency feeding method to the deployment structure includes a waveguide having a choke flange and a waveguide having a cover flange. Further, when the deployment structure is in a deployed state, the choke flange and the cover flange face each other. In this case, high-frequency power is supplied through the two waveguides.

In a deployable antenna device, highly efficient design and manufacture is desired. However, when the number of antenna elements in the high-frequency feeding circuit is not a power of 2, it may be difficult to realize symmetry or simplicity of a system.

That is, it is desirable that a design of each of antenna panels constituting a deployable phased array antenna be made as similar as possible to facilitate device design and manufacture. In addition, it is desirable to minimize the number of high-frequency feeding circuits across the antenna panels. To this end, it is necessary to form an array antenna having the same antenna panel for individual antenna elements. On the other hand, the number n of antenna panels (n is a natural number) may not be $^{2k-1}$ (k is a natural number) due to the requirements of mass characteristics such as a size of the antenna and a mass balance of the satellite. Thus, there is a need for a wide-band parallel feeding circuit which facilitates designing and manufacturing and can feed high-frequency signal in parallel to a number of antenna elements other than $2^{k-1}$.

SUMMARY OF THE INVENTION

The present invention provides an antenna device which is able to increase efficiency of design and manufacture. More specifically, the present invention provides an antenna device which is able to maintain symmetry and simplicity of a system even when the number of antenna elements in a feeding circuit is not a power of 2.

According to one aspect of the present invention, there is provided an antenna device including: an antenna panel; one input terminal through which a high-frequency signal is input; and a feeding circuit which distributes the high-frequency signal input to the input terminal to a plurality of antenna elements provided on the antenna panel. The feeding circuit includes: at least one first-stage branch circuit which includes one input and two outputs; at least two second-stage branch circuits which receive outputs of the first-stage branch circuit and include one input and two outputs; and a combining circuit which includes two inputs and one output and receives two outputs selected from the outputs of the first-stage branch circuit and outputs of the second-stage branch circuit.

According to the present invention, it is possible to realize an antenna device which can increase efficiency of design and manufacture. Further, it is possible to maintain uniformity of a feeding phase to each of antenna elements even when the number of antenna elements in a feeding circuit is not a power of 2.

DETAILED DESCRIPTION OF THE INVENTION

Figure 1:
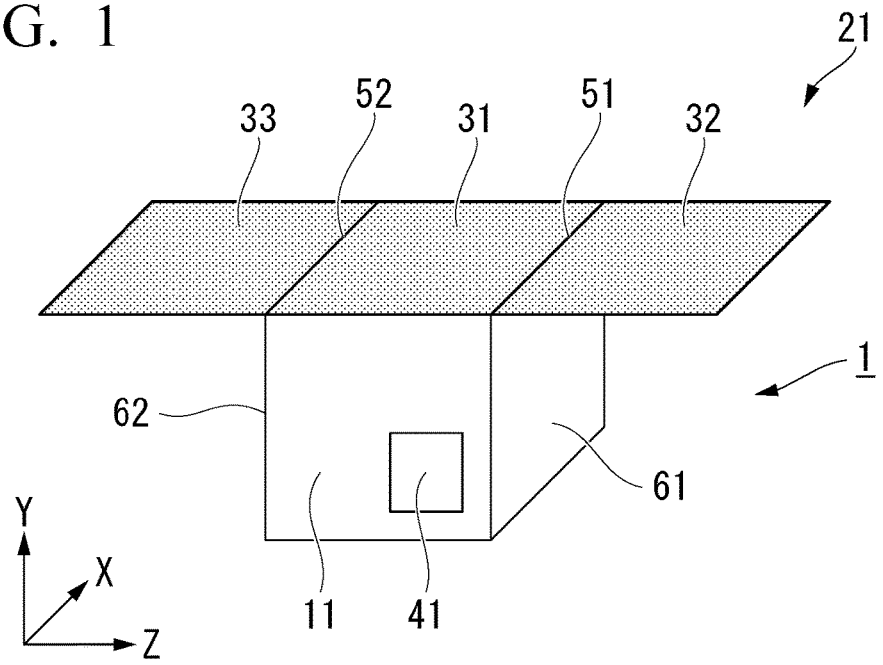
FIG. 1 is a diagram showing an example of a schematic exterior of an artificial satellite equipped with an antenna device according to one embodiment of the present invention.

Hereinafter, embodiments of the present invention will be described with reference to the drawings.

In the following, for convenience of description, XYZ coordinate axes which are three-dimensional orthogonal coordinate systems will be described with arrows in the drawings.

Further, in the following, for convenience of description, the term "electromagnetic wave" will be used, but in general, an electromagnetic wave having a frequency of 3 THz or less is also called "radio wave".

Further, in the following, for convenience of description, in a tournament-type feeding circuit, a stage in which the number of a plurality of waveguide paths are combined to be ½ in a direction from a bottom layer to a top layer will be referred to as a "layer". In this case, for example, an r-th layer has $2^{k-r}$ waveguide paths wherein r=1 to k.

Further, conversely, in the tournament-type feeding circuit, a stage in which one waveguide path is made into two in a direction from the top layer to the bottom layer may be referred to as a "layer". As a specific example, the r-th layer may have $2^{r-1}$ waveguide paths wherein for r=1 to k.

Additionally, in the following, for convenience of description, also in a configuration in which the number of branches is reduced from a tournament-type branch (that is, a configuration which is not strictly a tournament-type), the term "layer" in a tournament-type branch may be used for description.

[Antenna Device of Artificial Satellite or the Like]

In an embodiment, an antenna device of an artificial satellite will be described as an example, but technology according to the embodiment may be applied to other antenna devices.

<Exterior of Artificial Satellite>

FIG. 1 is a diagram showing an example of a schematic exterior of an artificial satellite 1 equipped with an antenna device 21 according to an embodiment of the present invention.

The artificial satellite 1 includes a satellite structure 11 which serves as a structure of the artificial satellite 1, and an antenna device 21.

In the embodiment, the satellite structure 11 has a cubic shape.

The antenna device 21 includes three deployment planar antenna panels 31 to 33, a high-frequency feeding circuit including a high-frequency source circuit 41, and deployment mechanisms (open/close connecting portions) 51 to 52. In the embodiment, the feeding circuit is provided in the antenna panels 31 to 33 or the like.

The antenna panels 31 to 33 are plate-shaped objects which constitute an antenna. In the embodiment, the square antenna panels 31 to 33 are used, but objects having other shapes may be used to constitute the antenna.

In the embodiment, the high-frequency source circuit 41 is provided inside the satellite structure 11.

Hereinafter, the antenna device 21 according to the embodiment will be described.

<Geometric Constitution of Deployment Panel>

In general, a geometric constitution for deploying antenna panels is determined on the basis of conditions such as a required antenna gain, a required radiation beam pattern, a shape and size of an artificial satellite at launch, or characteristics of a deployment mechanism, for example.

Further, as a method of deploying the antenna panel, there is a one-dimensional deployment method, a two-dimensional deployment method, a one-wing deployment method, a two-wing deployment method, or the like. In the one-dimensional deployment method, a plurality of antenna panels are deployed in a one-dimensional direction. In the two-dimensional deployment method, the plurality of antenna panels are deployed in a two-dimensional direction. In the one-wing deployment method, a deployment direction is one direction. In the two-wing deployment system, the plurality of antenna panels are deployed in two directions from the satellite structure 11.

The antenna device 21 corresponds to the two-wing deployment method. In the antenna device 21, the antenna panels 32 and 33 are deployed symmetrically side by side on a linear line (for example, to right and left) from the satellite structure 11 of the artificial satellite 1. Accordingly, symmetry of the mass characteristics of the artificial satellite 1 is maintained.

Further, in the antenna device 21, one antenna panel 31 is provided on a surface of the satellite structure 11. Then, an antenna surface in which three antenna panels 31 to 33 are linearly connected is formed. Thus, side lobes of the antenna device 21 are suppressed, and a practical antenna surface is obtained.

When such a configuration of the antenna surface is used, for example, the number of antenna panels is odd. In this example, the number of antenna panels is 3 which is an example of an odd number.

<Deployable Planar Antenna>

In the antenna device 21 according to the embodiment, one antenna panel 31 called a center panel is provided on one surface of the satellite structure 11. The surface of the satellite structure 11 and a surface of the antenna panel 31 have the same shape (or substantially the same shape).

An antenna panel 32 called a right wing is provided on one side of the antenna panel 31, and an antenna panel 33 called a left wing is provided on the opposite side of the antenna panel 31.

Each of surfaces of the three antenna panels 31 to 33 has the same shape (or substantially the same shape).

The antenna panel 32 and the antenna panel 33 are connected to the antenna panel 31 via the deployment mechanism 51 and the deployment mechanism 52 to be deployable and stowable (openable and closable). The deployment mechanism 51 and the deployment mechanism 52 have, for example, a hinge structure which can be deployed and stowed.

The antenna panel 32 and the antenna panel 33 are in a deployed state with respect to the antenna panel 31, and the surfaces of the antenna panels 32 and 33 and the surface of the antenna panel 31 are parallel (or substantially parallel) to each other and are located in series on the same plane (or substantially on the same plane). Therefore, an antenna constituted with the three antenna panels 31 to 33 is realized.

On the other hand, when the antenna panels 32 and 33 are in a stowed condition with respect to the antenna panel 31, the surfaces of the antenna panel 32 and the antenna panel 33 and a side surface 61 and a side surface 62 of the satellite structure 11 are respectively parallel (or substantially parallel) to each other. Each of the side surface 61 and the side surface 62 is one of four surfaces adjacent to the surface of the antenna panel 31 among the surfaces of the satellite structure 11. Thus, the artificial satellite 1 becomes compact as a whole and can be easily transported.

<Passive Phased Array Antenna>

The antenna device 21 according to the embodiment uses a passive phased array antenna. This is because it is easier to reduce costs in a passive phased array antenna than in an active phased array antenna.

<High-Frequency Source Circuit Provided Inside Satellite Structure>

In the antenna device 21 according to the embodiment, the high-frequency source circuit 41 for feeding a high-frequency power signal (high-frequency power) to the antenna is provided inside the satellite structure 11. This is because, in the passive phased array antenna, a predetermined electronic device such as a power amplifier for transmission or a low-noise amplifier for reception are not installed on the antenna panels 31 to 33. Therefore, in the passive phased array antenna, the electronic device is installed inside the satellite structure 11. Also, in the passive phased array antenna, a waveguide path for feeding microwaves or millimeter waves from the satellite structure 11 to the antenna panels 31 to 33 is provided.

The high-frequency source circuit 41 includes, for example, an electronic circuit other than a waveguide path which transmits a high-frequency signal for feeding high-frequency power (for convenience of description, also referred to as a "feeding signal") in a circuit for feeding a high-frequency signal to the antenna. The electronic circuit may include an electronic device such as a power amplifier for transmission and a low-noise amplifier for reception.

<Waveguide>

In the antenna device 21 according to the embodiment, a waveguide is used as a feeding path. This is because the waveguide is a feeding path which has the lowest loss for microwaves in a high frequency range or millimeter waves.

<Constitution in which Waveguides are Connected by Flange>

In the antenna device 21 according to the embodiment, the antenna panels 31 to 33 are deployed via the deployment mechanisms 51 and 52. In the embodiment, a structure of the deployment mechanism 51 and a structure of the deployment mechanism 52 are the same.

In addition, feeding waveguides of the adjacent antenna panels 31 to 33 are connected to each other by waveguide connecting portions. In the embodiment, a structure of the waveguide connecting portion which connects the waveguide of the antenna panel 31 to the waveguide of the antenna panel 32 and a structure of the waveguide connecting portion which connects the waveguide of the antenna panel 31 to the waveguide of the antenna panel 33 are the same.

[Example of High-Frequency Feeding Circuit of Antenna Device]

<One Example of High-Frequency Feeding Circuit>

Figure 2:
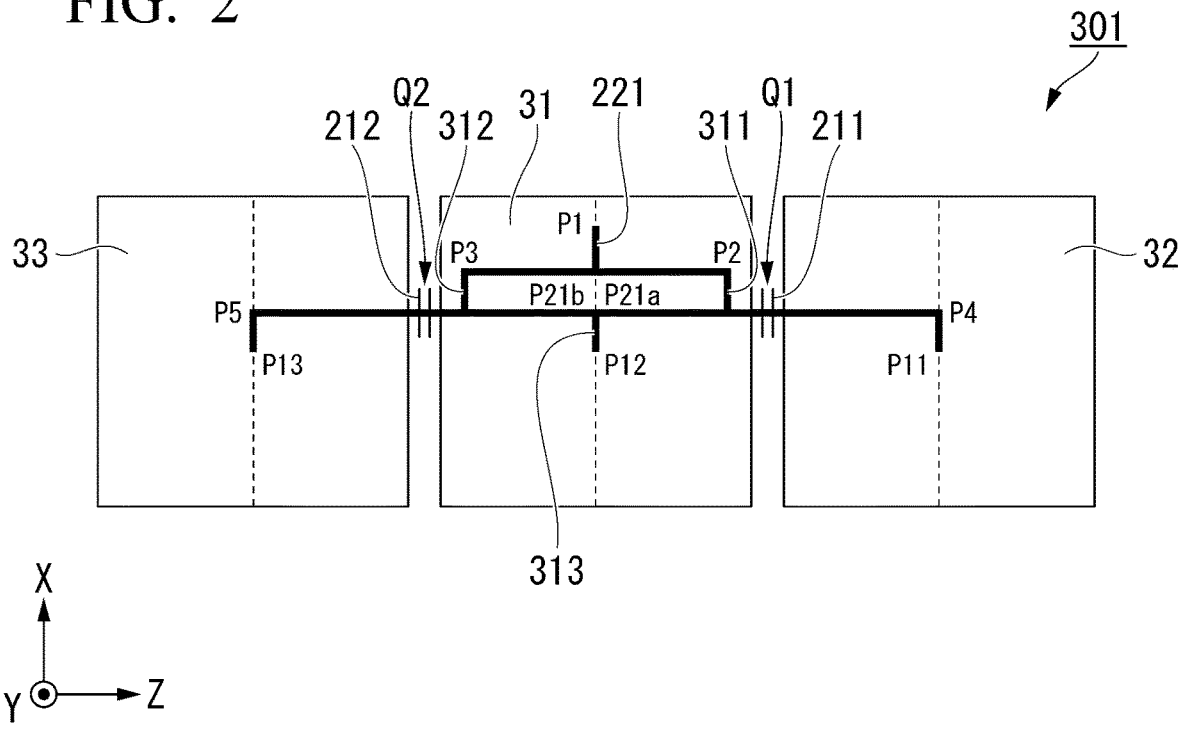
FIG. 2 is a diagram showing an example of a feeding circuit of the antenna device according to one embodiment of the present invention.

FIG. 2 is a diagram showing an example of a feeding circuit (high-frequency feeding circuit) 301 of the antenna device 21 according to one embodiment of the present invention.

The three antenna panels 31 to 33 are arranged along the Z axis. The antenna panels 31 and 32 are connected via a waveguide connecting portion 211, and the antenna panels 31 and 33 are connected via a waveguide connecting portion 212.

The feeding circuit 301 includes a combination of a branch circuit 221 which corresponds to a first-stage branch circuit, branch circuits 311 to 312 which correspond to a second-stage branch circuit, and one combining circuit 313. For convenience of description, points for indicating input terminals and output terminals of the branch circuits 221, 311 and 312 and the combining circuit 313 are indicated by points P1 to P5.

In addition, feed points P11, P12, and P13 of three antenna elements are shown. The antenna elements are carried on antenna panels 32, 31, and 33.

The branch circuit 221 corresponds to a three-terminal first-stage branch circuit having one input and two outputs. The branch circuit 221 may be provided on the antenna panel 31 or may be provided inside the satellite structure 11. The branch circuit 221 corresponding to the three-terminal first-stage branch circuit having one input and two outputs is provided. The input terminal of the branch circuit 221 is at the point P1. The input terminal is installed at the center of the antenna panel 31 in the Z-axis direction. The right output terminal of the branch circuit 221 is on the side of the point P2, and the left output terminal of the branch circuit 221 is on the side of the point P3. In the Z-axis direction, the points P2 and P3 are bilaterally symmetric with respect to a linear line which passes through the point P1 and is parallel to the X axis. That is, in the Z-axis direction, the branch circuit 221 is bilaterally symmetric with respect to the center of the antenna panel 31.

The branch circuit and the combining circuit are generally local.

The branch circuit 311 corresponding to a three-terminal second-stage branch circuit having one input and two outputs is provided over the antenna panel 31 and the antenna panel 32. The input terminal of the branch circuit 311 is at the point P2 which is also the output terminal side of the branch circuit 221. The input terminal is installed on the antenna panel 31. The right output terminal of the branch circuit 311 is on the side of the point P4, and the point P4 is installed on the antenna panel 32. The left output terminal of the branch circuit 311 is on the side of a point P21*a*, and the point P21*a* is installed on the antenna panel 31. The point P21*a* is installed at the center (or substantially the center) of the antenna panel 31 in the Z-axis direction.

The branch circuit 312 corresponding to the three-terminal second-stage branch circuit having one input and two outputs is provided over the antenna panel 31 and the antenna panel 33. The input terminal of the branch circuit 312 is at the point P3 which is also the output terminal side of the branch circuit 221. The input terminal is installed on the antenna panel 31. The left output terminal of the branch circuit 312 is on the side of the point P5, and the point P5 is installed on the antenna panel 33. The right output terminal of the branch circuit 312 is on the side of a point P21*b*. Here, the point (the point P21*a*) on the side of the left output terminal of the branch circuit 311 and the point (the point P21*b*) on the side of the right output terminal of the branch circuit 312 are actually slightly shifted from each other and are connected to the common combining circuit 313.

Also, a three-terminal combining circuit 313 having two inputs and one output is provided on the antenna panel 31. The two input terminals of the combining circuit 313 are at the points P21*a* and P21*b*, one input terminal is connected to the output terminal of the branch circuit 312, and the other input terminal is connected to the output terminal of the branch circuit 311. The high-frequency signals input from the two input terminals are combined, for example, at equal magnitudes.

The two input terminals (the point P21*a*) and (the point P21*b*) of the combining circuit 313 are actually slightly shifted and are guided to a common output terminal.

Here, the three branch circuits 221, 311 and 312 and one combining circuit 313 are installed to be bilaterally symmetric with respect to the center of the antenna panel 31 in the Z-axis direction. That is, the one-input two-output branch circuit 312 is installed with respect to the branch circuit 311 to be bilaterally symmetric with respect to the center of the antenna panel 31 in the Z-axis direction.

The three branch circuits 221, 311 and 312 and one combining circuit 313 are each constituted using a waveguide. When the output terminal of one branch circuit and the input terminal of another branch circuit face the same point, they are connected to each other. Then, the high-frequency signal output from the output terminal is input to the input terminal. Further, the output terminal of the high-frequency source circuit 41 is connected to an input terminal of a first branch circuit 221, and a high-frequency signal supplied from the high-frequency source circuit 41 is input to the input terminal.

The branch circuit 311 is constituted to include the waveguide of the waveguide connecting portion 211. The branch circuit 312 is constituted to include the waveguide of the waveguide connecting portion 212.

In the embodiment, the waveguides of the branch circuits 221, 311 and 312 and the combining circuit 313 are mainly installed parallel to the Z axis or the X axis but are not necessarily limited to such an arrangement, and other arrangements may be used.

With such a configuration, the feeding circuit 301 has one input terminal and three output terminals as a whole. That is, the high-frequency signal is input from the point P1, and the high-frequency signal is output from the three antenna elements. At this time, the high-frequency signal is divided at a branch point of each of the high-frequency signal so that, for example, signal levels at three last antenna elements are equal.

As another example, the high-frequency signal may be divided in a manner in which the signal levels at the three last antenna elements are not equal (that is, non-uniform manner).

In the embodiment, since two two-branch circuits are changed to one two-input one-output combining circuit 313 based on a one-input four-output feeding circuit, and an output of the second-stage branch circuit 311 and an output of the second-stage branch circuit 312 are combined as an input and then output, a one-input three-output feeding circuit 301 is constituted.

In the feeding circuit 301, since the arrangement of the respective components is actually adjusted, a phase shift of electromagnetic waves may occur in a path (in the embodiment, the waveguide) of the electromagnetic waves. In this case, for example, the phase shift can be compensated for by fine adjustment of a length of the path.

The high-frequency signal supplied from the high-frequency source circuit 41 is radiated into the air outside the antenna device 21 as wireless electromagnetic waves.

For example, a constitution in which electromagnetic waves (electromagnetic waves of the high-frequency signal) leak from output terminals (last output terminals) P11, P12, and P13 of the three last antenna elements may be used.

Also, for example, a constitution in which holes (slots) are provided in the waveguides of the branch circuits 221, 311 and 312 and the combining circuit 313 and the electromagnetic waves (the electromagnetic waves of the high-frequency signal) leak from the holes may be used.

<One Example of Feeding Circuit of Slot Array Antenna Using Honeycomb Panel and Slot>

Figure 3:
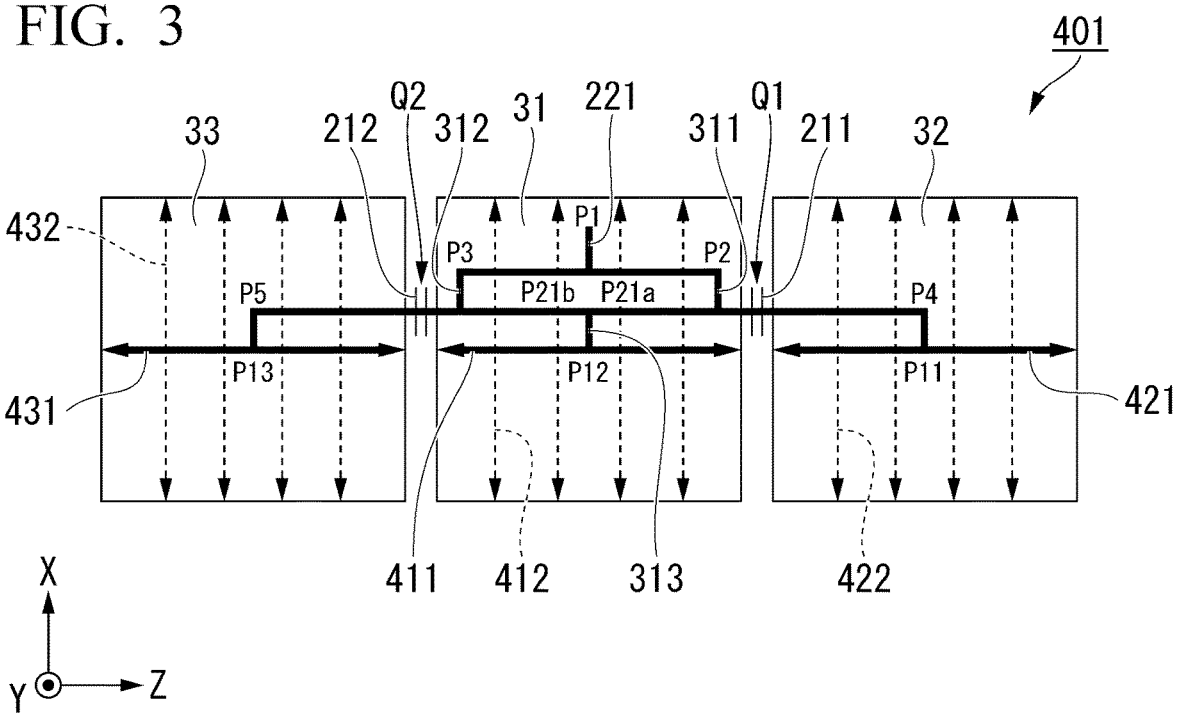
FIG. 3 is a diagram showing an example of a feeding circuit of an antenna device using a slot array antenna using a honeycomb panel and slots according to one embodiment of the present invention.

Details in which the electromagnetic waves are radiated into the air will be described with reference to FIG. 3. FIG. 3 is a diagram showing an example of a feeding circuit 401 of the antenna device 21 using a slot array antenna using a honeycomb panel and a slot according to one embodiment of the present invention. Parts the same as those of the feeding circuit 301 shown in FIG. 2 are designated by the same reference numerals.

A coupling slot (a cut-out hole) is provided in the waveguide for high-frequency feeding. For example, a plurality of coupling slots are provided in the waveguide. Then, a method in which the electromagnetic waves (traveling waves) of the high-frequency signal are supplied from the coupling slot to a waveguide of a parallel plate formed of a honeycomb panel which is in close contact with the waveguide is used. In a deployment direction (the Z-axis direction), the signal is propagated inside last waveguides 411, 421, and 431. The signal coupled to the parallel plate from the coupling slot is propagated through the waveguide of the parallel plate as an approximate plane wave traveling in the X-axis direction.

Here, the last waveguides 411, 421, and 431 are waveguides having slots.

Specifically, the electromagnetic waves of the high-frequency signal supplied from the high-frequency source circuit 41 are carried to a waveguide constituted by the waveguides of the three branch circuits 221, 311 and 312 and one combining circuit 313.

Further, the electromagnetic waves are propagated to the last waveguides 411, 421, and 431 parallel to the Z-axis direction.

The electromagnetic waves leaked from the coupling slot are propagated through propagation paths 412, 422, and 432 parallel to the X-axis direction inside the parallel plate.

Further, a plurality of radiation slots are provided on a skin of the parallel plate which faces the outside. Then, the electromagnetic waves of the high-frequency signal leak from the waveguides 411 to 412, 421 to 422, and 431 to 432 inside the parallel plate to the radiation slots.

Here, in the supplying of the traveling waves using slots, for example, for a plurality of slots which leak the same electromagnetic waves, a phase of the electromagnetic waves (a phase of the signal) which leak from each of the slots is adjusted to the same phase based on a center frequency. However, in this case, at a frequency away from the center frequency, the phase of the electromagnetic waves which leak from each of the slots may be shifted according to a length of a supply path of the traveling waves (in this embodiment, a length of the waveguide). Additionally, a frequency bandwidth of the antenna is determined in consideration of such a phase shift.

For this reason, for example, when shapes of the surfaces of the antenna panels 31 to 33 are square, the waveguide for feeding is installed with reference to the center of each of the antenna panels 31 to 33 in the deployment direction (the Z-axis direction). Thus, the frequency bandwidth in the deployment direction (the Z-axis direction) and a direction (the X-axis direction) orthogonal thereto is effectively shared.

Here, the one-input two-output branch circuit is applied in the feeding of a standard tournament type. On the other hand, in the feeding circuit 301 shown in FIG. 2, the number of outputs (the number of antenna elements) is reduced using a path of a two-input one-output waveguide (a path of the combining circuit 313).

Specifically, the feeding circuit 301 shown in FIG. 2 includes one two-input one-output combining circuit 313 at a center portion of the central antenna panel 31. Thus, when the number of layers (k in this example) is 3, the total number of antenna elements is 4 in the standard tournament type circuit but is 3 in the array antenna shown in FIG. 2. That is, in the array antenna shown in FIG. 2, the number of antenna elements is reduced by one.

Here, the two-input one-output combining circuit 313 performs combining of two inputs and dividing of one output in a spatially compact structure.

Further, for example, in the feeding circuit 301 shown in FIG. 2, also when a constitution in which slot coupling is used in the antenna device 21 is applied, excitation via the slots can be made spatially uniform, and a decrease in antenna aperture efficiency can be avoided.

As described above, in the antenna device 21 according to the embodiment, a high-frequency signal can be transmitted and received with a high gain and a wide band using the deployable planar antenna panel. Also, in the antenna device 21 according to the embodiment, a volume in the stowed condition can be reduced, and thus the antenna device 21 can be applied to a small artificial satellite. Moreover, in the antenna device 21 according to the embodiment, cost reduction can be achieved.

In addition, the antenna device 21 according to the embodiment may be particularly constituted as the array antenna using the honeycomb panel and the slot. Such a constitution is lower in cost and is suitable for mass production as compared with, for example, a constitution using a conventional parabolic antenna or a constitution using a conventional active array antenna.

As an example, in the antenna device 21 according to the embodiment, it is possible to realize a low-cost and light-weight deployable antenna having a length of about several meters in which an electronic sweep of an electromagnetic wave beam is not required.

For example, planar waveguide slot antennas have developed significantly in recent years and have high efficiency. Such a planar waveguide slot antenna is constituted as an antenna panel (the antenna panels 31 to 33 in the example of FIG. 1) so that several antenna panels can be deployed. Then, the high-frequency source circuit 41 mounted on a main body portion (the satellite structure 11 in the example of FIG. 1) of the artificial satellite 1 feeds a high-frequency signal to the waveguide in a non-contact manner and with low loss. The high-frequency source circuit 41 serves as, for example, a device which transmits and receives a high-frequency signal.

In the embodiment, a signal is fed to the antenna element using the waveguide which is a waveguide path with the lowest loss in a high frequency region. As a method having high affinity with respect to this method, a method in which a coupling slot is provided in a feeding waveguide and a traveling wave is supplied to a parallel plate waveguide formed of a honeycomb panel which is in close contact with the feeding waveguide is conceivable. The signal which leaks from each of the coupling slots to the parallel plate is propagated through the parallel plate waveguide as an approximate plane wave traveling in a direction orthogonal to the deployment direction. A radiation slot to which the traveling waves are supplied is provided in the other skin of the honeycomb panel, and the signal is radiated as electromagnetic waves to a free space.

One example of a field of application of the antenna device according to the embodiment is a technology for realizing a low-cost and light-weight deployable antenna having a length of about several meters in which an electronic sweep of an electromagnetic wave beam is not required. High-efficiency planar waveguide slot antennas have developed significantly in recent years. With deploying such high-efficiency planar waveguide slot antennas, high frequency signals are fed through the waveguide from a high-frequency transmitting/receiving device mounted in a main body of an artificial satellite in a non-contact manner and with a low loss by using the technology according to the embodiment. Accordingly, earth observation and monitoring missions and the like with a microwave synthetic aperture radar (SAR) can be performed, for example, using a small artificial satellite which occupies an accommodation area of 1 m or less when it is mounted in a rocket.

In recent years, various earth observation and monitoring missions have been realized by small artificial satellites, but most observation instruments are optical telescopes with a diameter of about 10 cm. In order to perform the observation and monitoring without being influenced by night or weather, it is necessary to mount an electromagnetic wave sensor such as the synthetic aperture radar (SAR) which requires an antenna having a size of several meters in a small artificial satellite. The antenna device 21 according to the embodiment can realize such a constitution.

The constitution described in the following Thesis 1 can be used as a constitution of a waveguide feeding type slot array antenna using a honeycomb panel.

<Thesis 1> Prilando Rizki Akbar, Hirobumi Saito, Miao ZHANG, Jiro Hirokowa, Makoto Ando, "Parallel-Plate Slot Array Antenna for Deployable SAR Antenna onboard Small Satellite", IEEE Trans on Antennas and Propagation, VOL. 64, NO. 5, MAY 2016, pp. 1661-1671

Also, for a design of the slot array antenna, the one described in the following Thesis 2 can be used.

<Thesis 2> Budhaditya Pyne, IEEE, Prilando Rizki Akbar, Vinay Ravindra, Hirobumi Saito, Jiro Hirokowa, and Tomoya Fukami, "Slot-Array Antenna Feeder Network for Space-Borne X-Band Synthetic Aperture Radar", IEEE Trans on Antennas and Propagation, electronic version Apr. 24, 2018

<Antenna Devices with Different Numbers of Antenna Panels>

Here, the number n of antenna panels included in the antenna device 21 may be other than three. As an example, the number n of antenna panels may be seven.

[Reduction of Antenna Element]

Here, details of adjustment of a feed point to the antenna element in the feeding circuit used in the embodiment will be described with reference to FIGS. 4 to 8.

In a passive array antenna in which a wide operating frequency range (a wide band) is required, a feeding phase to each of the antenna elements is required to be uniform in a wide frequency range. Therefore, in such a passive array antenna, a parallel feeding method in which a high-frequency signal is supplied in parallel from a signal source to each of the antenna elements with the same electrical length is adopted.

A three-terminal branch circuit having one input and two outputs, in which circuits and lines are easily installed, is used for branching the signal from the high-frequency source (high-frequency signal feeding source) to the antenna element. Therefore, the parallel feeding circuit is a tournament type, and the number of antenna elements is a power of 2, that is, $2^{k-1}$. k represents the number of layers in the tournament and is a natural number. Here, the number of layers in the tournament is a number which increases by one whenever a signal passes through the three-terminal branch circuit having one input and two outputs.

The branch circuit may be referred to as a branch circuit.

Figure 4:
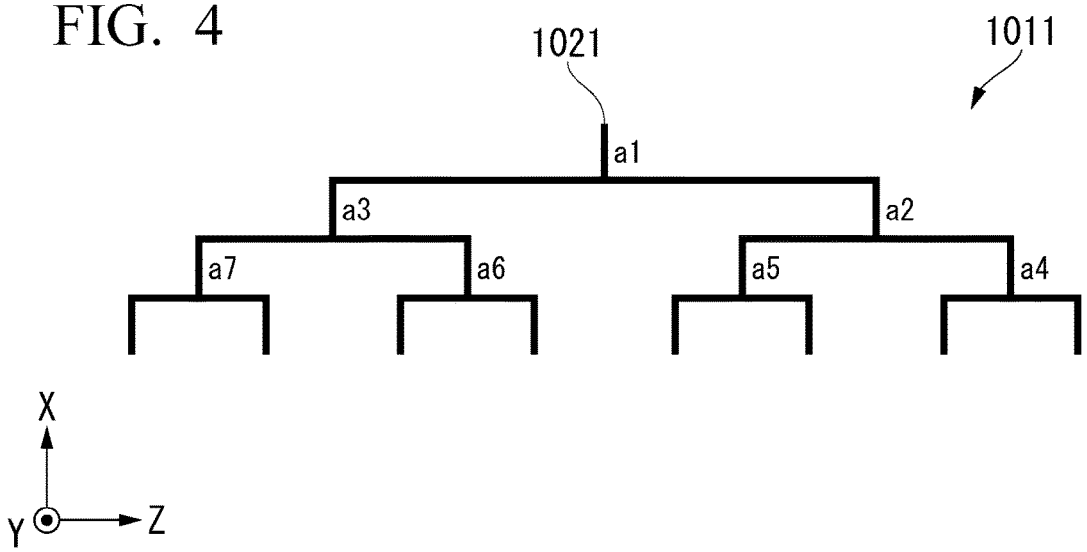
FIG. 4 is a diagram showing an example of a tournament-type parallel feeding circuit having eight antenna elements according to one embodiment of the present invention.

FIG. 4 is a diagram showing an example of a tournament-type parallel feeding circuit 1011 having eight antenna elements.

The parallel feeding circuit 1011 is divided into two from the feed point 1021 at a branch point a1 corresponding to a first branch circuit, is further divided into two at a branch point a2 and a branch point a3 corresponding to a second branch circuit, and is further divided into two at branch points a4 to a7 corresponding to the second branch circuit when the branch point a2 and the branch point a3 are set as the first branch circuit, and thus eight antenna elements are constituted.

Such a parallel feeding circuit 1011 is a standard (normal) tournament circuit in which the number of antenna elements is n=8 and the number of layers is k=4. In the embodiment, a bilaterally symmetric feeding circuit which can cope with a case in which the number of antenna elements is not $2^{k-1}$ in the passive array antenna is realized.

It is desirable that each of the antenna panels has the same design to facilitate device design and manufacture. In addition, it is desirable to minimize the number of feeding circuits across the antenna panels. To this end, it is necessary to form the array antenna having the same antenna panel as one antenna element. On the other hand, the number n (n: natural number) of antenna panels may not be $2^{k-1}$ due to the demand for mass characteristics such as a size of the device and a mass balance of the device. Thus, it is required a wide band parallel feeding circuit in which high-frequency signals can be supplied to a number of antenna elements other than $2^{k-1}$ in parallel and design and manufacture are easy. In particular, in the case of a linear array antenna, it is necessary to install a number of elements other than $2^{k-1}$ in a bilaterally symmetric arrangement.

It is considered a linear array antenna in which the number n of antenna elements is not equal to $2^{k-1}$ ($n \neq 2^{k-1}$). For wideband characteristics, the electrical lengths of the feeding circuits to the n antenna elements is required to be equal. In order to set the number of layers k to $n > 2^{k-1}$ with respect to the number n of antenna elements, it is required a complicated circuit having a four or more-terminal circuit such as one input and three outputs. In addition, it is difficult to install the circuits connected to the three outputs with the same electrical length in a planar manner.

Here, in the embodiment, for convenience of explanation, the number of layers other than the tournament type is assumed to be equal to the number of layers when the tournament type is assumed.

In the embodiment, the number of layers k is set to $n < 2^{k-1}$ with respect to the number n of antenna elements. In the standard tournament-type parallel feeding circuit, since the number of antenna elements is $2^{k-1}$, it is necessary to reduce the number of branches in the bottom layer of the standard tournament-type feeding circuit by $(2^{k-1}-n)$.

FIGS. 5 to 8 show examples of the parallel feeding circuits in which the number of antenna elements is reduced based on the tournament-type parallel feeding circuit 1011 shown in FIG. 4.

Here, in the embodiment, in order to simplify the description, a linear array in which intervals between the antenna elements are uniform is used.

Figure 5:
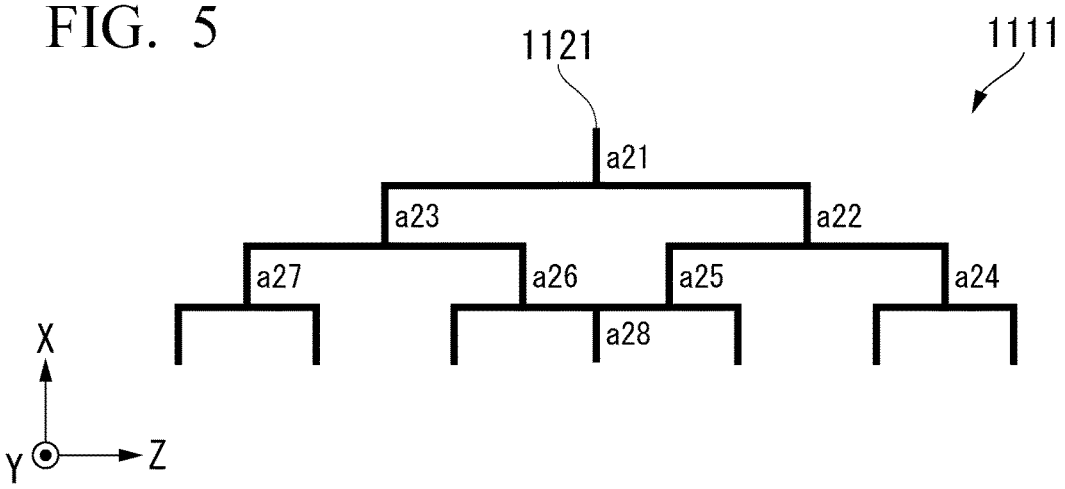
FIG. 5 is a diagram showing an example of a parallel feeding circuit having seven antenna elements according to one embodiment of the present invention.

FIG. 5 is a diagram showing an example of a parallel feeding circuit 1111 having seven antenna elements.

Seven antenna elements are constituted in the parallel feeding circuit 1111. The seven antenna elements are configured such that the parallel feeding circuit 1111 is started from a high-frequency source (high frequency signal feeding source) 1121, is divided into two at a branch point a21 corresponding to the first-stage branch circuit, is further divided into two at branch points a22 and a23 corresponding to the second-stage branch circuit and is further divided into two at branch points a24 to a27 corresponding to the second-stage branch circuit when outputs of the branch points a22 and a23 are used as the first-stage branch circuit, and two inputs which are outputs of the branch points a25 and a26 corresponding to the second-stage branch circuit are combined at a combining point a28 corresponding to the combining circuit to form one output.

Here, although the branch points a21 to a27 perform the same branch as in the tournament-type branch point, a power distribution ratio is set so that the same amount of power is supplied to each of the seven antenna elements. Also, the electrical lengths are required to be equal, but the same amount of power may not be supplied. Non-uniform power distribution may occur according to the design.

Further, the combining point a28 combines one signal branched by the branch point a25 with one signal branched by the branch point a26.

In the parallel feeding circuit 1111 shown in FIG. 5, the combining point a28 in a circuit portion to the three antenna elements after the branch point a25 and the branch point a26 is realized by the combining circuit. Thus, a feeding circuit with good bilateral symmetry is provided by disposing one combining circuit at the center portion of the antenna between a first layer and a second layer (a layer in a direction from the bottom layer to the top layer).

Figure 6:
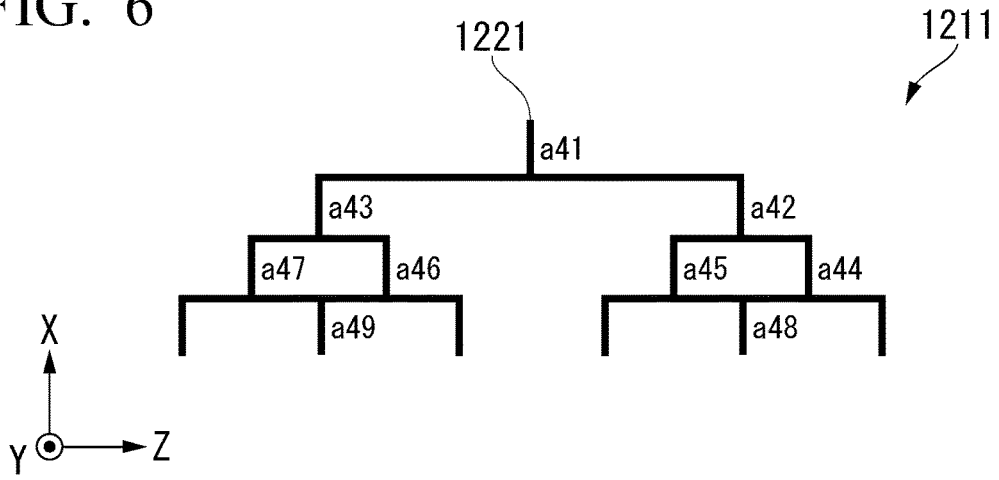
FIG. 6 is a diagram showing an example of a parallel feeding circuit having six antenna elements according to one embodiment of the present invention.

FIG. 6 is a diagram illustrating an example of a parallel feeding circuit 1211 having six antenna elements.

The parallel feeding circuit 1211 is divided into two from a high-frequency source 1221 at a branch point a41 corresponding to the first-stage branch circuit, is further divided into two at branch points a42 and a43 corresponding to the second-stage branch circuit, and is further divided into two at branch points a44 to a47 corresponding to the second-stage branch circuit when the branch points a42 and a43 are set as the first-stage branch circuit, and two inputs are combined at combining points a48 and a49 corresponding to the combining circuit to form one output, and thus six antenna elements are constituted.

Also here, the power distribution ratio is set so that the same amount of power is supplied to each of the six antenna elements as a whole of the parallel feeding circuit 1211. The electrical lengths are required to be equal, but the same amount of high-frequency power may not be supplied. The non-uniform amplitude distribution may occur according to the design.

Further, the combining point a48 combines one signal branched by the branch point a44 with one signal branched by the branch point a45, and the combining point a49 combines one signal branched by the branch point a46 with one signal branched by the branch point a47.

In the parallel feeding circuit 1211 shown in FIG. 6, the combining point a48 in a circuit portion to the three antenna elements after the branch point a42 is constituted by the combining circuit, and the combining point a49 in a circuit portion to the three antenna elements after the branch point a43 is constituted by the combining circuit. Thus, a feeding circuit with good bilateral symmetry is provided by installing two combining circuits between a first layer and a second layer.

Figure 7:
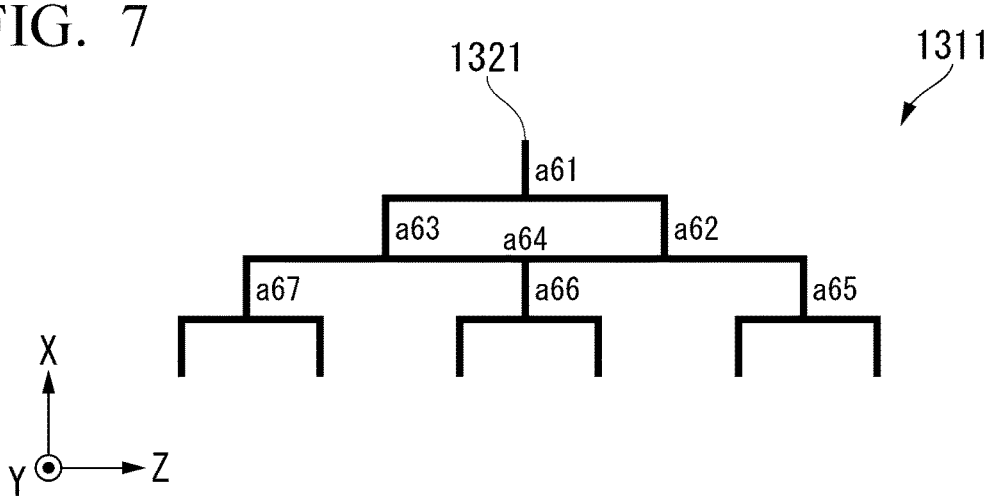
FIG. 7 is a diagram showing an example of a parallel feeding circuit having six antenna elements according to one embodiment of the present invention.

FIG. 7 is a diagram illustrating an example of a parallel feeding circuit 1311 having six antenna elements.

The parallel feeding circuit 1311 is divided into two from a high-frequency source (high frequency signal feeding source) 1321 at a branch point a61 corresponding to the first-stage branch circuit and is further divided into two at branch points a62 and a63 corresponding to the second-stage branch circuit, and two inputs are combined at combining point a64 corresponding to the combining circuit to form one output, and the parallel feeding circuit 1311 is further divided into two at each of branch points a65 to a67, and thus six antenna elements are constituted. Here, although the branch points a61 to a63 perform the same branch as in the tournament-type branch point, the power distribution ratio is set so that the same amount of power is supplied to each of the six antenna elements as a whole of the parallel feeding circuit 1311. The electrical lengths are required to be equal, but the same amount of high-frequency power may not be supplied. The non-uniform power distribution may occur according to the design.

Further, the combining point a64 combines one signal branched by the branch point a62 with one signal branched by the branch point a63, the branch point a65 branches one signal branched by the branch point a62, the branch point a66 branches the signal combined by the combining point a64, and the branch point a67 branches the other signal branched by the branch point a63.

In the parallel feeding circuit 1311 shown in FIG. 7, the combining point a64 in a circuit portion to the six antenna elements after the branch point a61 is realized by the combining circuit. Thus, a feeding circuit with good bilateral symmetry is provided by installing one combining circuit between a second layer and a third layer.

Figure 8:
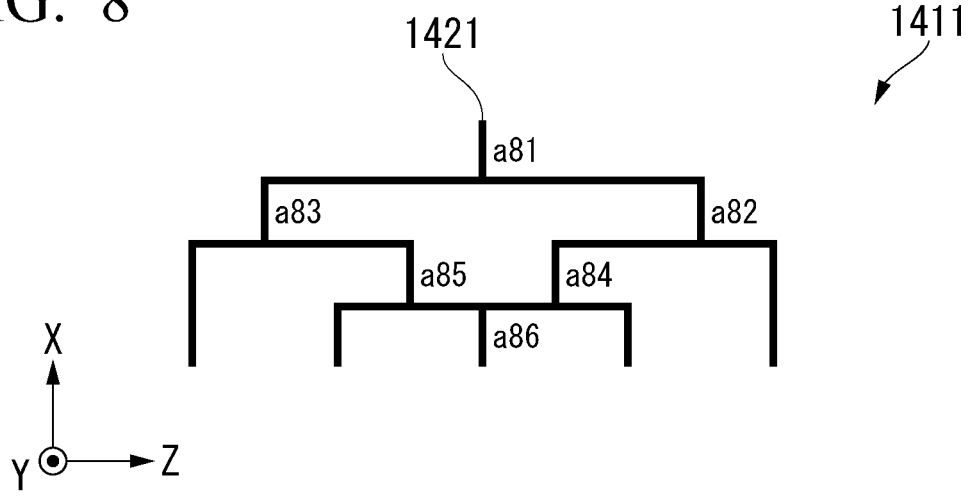
FIG. 8 is a diagram showing an example of a parallel feeding circuit having five antenna elements according to one embodiment of the present invention.

FIG. 8 is a diagram illustrating an example of a parallel feeding circuit 1411 having five antenna elements.

The parallel feeding circuit 1411 is divided into two from a high-frequency source (high frequency signal feeding source) 1421 at a branch point a81 corresponding to the first-stage branch circuit, is further divided into two at branch points a82 and a83 corresponding to the second-stage branch circuit, and is further divided into two at branch points a84 and a85 corresponding to the second-stage branch circuit when the branch points a82 and a83 are set as the first-stage branch circuit, and two inputs are combined at a combining point a86 corresponding to the combining circuit to form one output, and thus five antenna elements are constituted.

Here, the power distribution ratio is set so that the same amount of power is supplied to each of the five antenna elements as a whole of the parallel feeding circuit 1411. The electrical lengths are required to be equal, but the same amount of high-frequency power may not be supplied. The non-uniform power distribution may occur according to the design.

Further, the branch point a84 branches one signal branched by the branch point a82, the branch point a85 branches one signal branched by the branch point a83, and the combining point a86 combines one signal branched by the branch point a84 with one signal branched by the branch point a85.

In the parallel feeding circuit 1411 shown in FIG. 8, the combining point a86 in a circuit portion to the three antenna elements after the branch point a84 and the branch point a85 is constituted by the combining circuit, and a feeding circuit with good bilateral symmetry is provided by installing one combining circuit at the center portion of the antenna between a first layer and a second layer.

Further, the feeding circuit with good bilateral symmetry is provided by applying a first reduction method bilaterally symmetrically at both right and left ends of the second layer. The first reduction method will be described later.

<Feeding Circuit when the Total Number of Antenna Elements is not a Power of 2>

For example, when the artificial satellite 1 has symmetric mass characteristics, as in the example of FIG. 1, the number n of the antenna panels 31 to 33 is an odd number. In this case, the standard tournament circuit cannot be used as it is.

The adjustment of the total number of antenna elements performed in the embodiment will be described.

It is based on a tournament circuit having a total of $2^{k-1}$ antenna elements which is an even number. Then, the total number of antenna elements is reduced from $2^{k-1}$ to match the actual total number of antenna elements.

At this time, for example, a condition of equal length feeding circuit (equal length wiring) is satisfied. The condition is that a length of the feeding circuit (wiring) from a common input terminal to an end of each of outputs is equal. Also, a parallel feeding circuit which matches the total number of antenna elements is identified using the diving circuit or the combining circuit other than the three-terminal circuit having one input and two outputs.

For example, it is considered that it is difficult to increase the total number of antenna elements from a standard tournament circuit having the number of layers which satisfies ($2^{k-1}$<the number of antenna elements). This is because a waveguide having three or more outputs with one input has a complicated shape and occupies an area and thus it is difficult to mount the waveguide on the antenna panel.

Accordingly, in the embodiment, a waveguide which can reduce the total number of antenna elements is selected based on a standard tournament circuit having the number of layers satisfying ($2^{k-1}$> number of antenna elements).

<Method of Reducing the Number of Antenna Elements>

Here, a method of reducing the number of antenna elements (also, referred to as a "reduction method" for convenience of description) will be described.

In the embodiment, a first reduction method and a second reduction method will be described.

The first reduction method will be described.

The first reduction method is a method in which it is assumed that m is an integer equal to or greater than 1, a two-input one-output combining circuit is replaced with a one-input one-output circuit when seen from the high-frequency source side between a m-th layer and a (m+1)-th layer counted from the bottom layer directly connected to the antenna element, and thus branches are not formed any more. As a result, the total number of antenna elements is reduced by $2^{(m-1)}$. Here, a simple waveguide may be used in a one-input one-output circuit, that is, when a signal simply passes therethrough, one input and one output are obtained.

Figure 9:
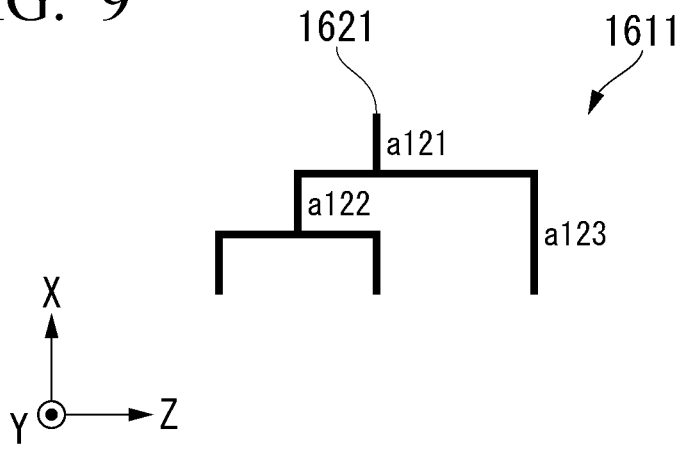
FIG. 9 is a diagram for explaining a reduction method according to one embodiment of the present invention.

FIG. 9 is a diagram for explaining a reduction method (the first reduction method) according to one embodiment of the present invention.

A feeding circuit portion 1611 is a circuit portion which can form a parallel feeding circuit.

In the feeding circuit portion 1611, one wiring 1621 is divided into two at a branch point a121, one of the two parts is divided into two at a branch point a122, and the other is not branched at a non-branch point a123. The non-branch point a123 is constituted by, for example, a one-input one-output circuit.

The first reduction method is a method in which a branch is not formed any more, as in the non-branch point a123.

The second reduction method will be described.

In the second reduction method, the number is reduced by combining two adjacent branches into one branch in a two-input one-output combining circuit when seen from the high-frequency source side between a m-th layer and a (m+1)-th layer counted from the bottom layer directly connected to the antenna element. As a result, the total number of antenna elements is reduced by $2^{(m-1)}$.

Such a combining circuit can be obtained by reversing input and output of input and output terminals of a branch circuit used in a conventional $n=2^{k-1}$ standard tournament-type feeding circuit.

Since two signals input to the combining circuit have the same phase, the signals are output to an output circuit without loss, as is known as the characteristics of the branch circuit and the combining circuit.

Further, when the electrical length is changed by the branch circuit or the combining circuit, a position of the circuit is finely adjusted to equalize the electrical length to each of the antenna element. As described above, a method of adjusting the electrical length is a method which can be performed in other places, but in the embodiment, the description of other places will be omitted.

Further, when the combining circuit between a (m+1)-th layer and a m-th layer and the branch circuit between the m-th layer and a (m−1)-th layer approach each other as compared with a wavelength, it is also possible to design and manufacture two circuits integrally to form a two-input two-output composite branch circuit.

As described above, in the embodiment, in the constitution of the standard tournament-type feeding circuit, the number of branches (that is, the number of antenna elements) in the bottom layer can reduced by an arbitrary number ($2^{k-1}-n$) by applying one or both of the first reduction method and second reduction method to various layers. At this time, it is possible to equalize the electrical length to the arbitrary n antenna elements, and it is possible to supply power with the same phase over a wide band. However, also in the case of uniform amplitude excitation, it is necessary that a branch ratio of the branch circuit which connects the adjacent layers is not 1:1.

With such a reduction method, the number of antenna elements other than $2^{k-1}$ can be installed bilaterally symmetrically.

Here, since a two-dimensional array can be constituted by combining a linear array, the case of a linear array will be described.

When n is an even number, the first reduction method and the second reduction method are applied bilaterally symmetrically to the tournament circuit having $2^{k-1}$ antenna elements. Therefore, the number of antenna elements can be reduced by ($2^{k-1}-n$) which is an even number, and a linear array having n bilaterally symmetric antenna elements can be constituted.

When n is an odd number, first, the second reduction method is applied to two adjacent antenna elements at the center of the bottom layer (the first layer) of the tournament circuit having 2k−1 antenna elements, and thus a bilaterally symmetric array antennas having an odd number of ($2^{k-1}-1$) antenna elements is obtained. Next, the first reduction method and the second reduction method are bilaterally symmetrically applied to the obtained feeding circuit, and thus the number of antenna elements can be reduced by an even number. Finally, a bilaterally symmetric feeding circuit having an odd number of n antenna elements is obtained.

For example, when it is assumed that the branch is a tournament-type branch, the number of branches to be reduced afterward is increased when the reduction method is applied to a place in which the number of branches to be branched afterward is large.

In the embodiment, it is intended to realize an antenna device having equal length and symmetry while a basic structure of each of the antenna panels is shared.

As described above, in the antenna device 21 according to the embodiment, the number of antenna elements is reduced with respect to the tournament-type parallel feeding circuit, and a parallel feeding circuit of a bilaterally symmetric array antenna having an arbitrary number of antenna elements is realized.

One of a method in which a one-input two-output branch circuit is replaced with a one-input one-output circuit so as not to increase the number of branches and a method in which the number of branches is reduced by combining adjacent branches in a predetermined tournament-type layer using a two-input one-output combining circuit, or a combination of both methods is used as the method of reducing the number of antenna elements.

In the antenna device 21 according to the embodiment, high-frequency signal can be supplied to an arbitrary number of antenna elements in the array antenna in parallel with good symmetrical arrangement.

As described above, in the antenna device 21 according to the embodiment, it is possible to easily realize the symmetry in the deployable antenna device even when the number of antenna elements of the feeding circuit is not a power of 2, and thus high efficiency in design and manufacture can be achieved.

Additionally, in the antenna device 21 according to the embodiment, it is possible to realize an antenna device having a small volume in the stowed condition and low cost.

<Constitution Example>

As one constitution example, an antenna device (the antenna device 21 in the example of FIG. 2) includes a plurality of antenna panels (the antenna panels 31 to 33 in the example of FIG. 2) and includes one input terminal (the terminal at the point P1 in the example of FIG. 2) through which a high-frequency signal is input, a feeding circuit (the circuit from the point P1 to the points P11 to P13 and the feeding circuit 301 in the example of FIG. 2) which distributes the high-frequency signal input to an input terminal to signals of the plurality of antenna elements, and a plurality of output terminals (the terminals at the points P11 to P13 in the example of FIG. 2) from which the signals of the plurality of antenna elements are output. The total number of output terminals is not a power of 2. The feeding circuit includes a one-input two-output branch circuit (the branch circuits 221 and 311 to 312 at the points P1 to P3 in the example of FIG. 2), and a two-input one-output combining circuit (the combining circuit 313 at the points P21*a* and P21*b* in the example of FIG. 2).

In the antenna device as the constitution example, one combining circuit is installed at least at the center in a direction in which the plurality of antenna elements are arranged (the direction parallel to the Z axis in the example of FIG. 2).

[Arrangement of Branch Points]

When the array antenna is applied to an artificial satellite, a ground-based mobile communication antenna, or the like, an antenna panel on which the antenna is mounted is often deployed to form an array antenna having a larger area. In particular, a parallel feeding method is suitable for a passive array antenna in which wideband characteristics are required. The branch circuit required for the parallel feeding method needs to be installed at a position at which interference with a deployment connecting portion is avoided. Here, in the deployment connecting portion, a deployment operation is performed mechanically.

In the embodiment, in a deployable passive array antenna, interference between the diving circuit of the deployable feeding circuit and the deployment connecting portion is avoided.

In order to feed high-frequency to each of the antenna panels with the same phase, the branch circuit of the feeding circuit may interfere with the deployment connecting portion of the antenna panel. As an example, a case in which a feed point of the antenna panel is located at the center of the antenna panel in the deployment direction is shown. In such a case, it is not practical to install the branch circuit at the deployment connecting portion. In such a case, it is desired to realize a feeding circuit having the wideband characteristics.

<Arrangement of Diving Circuit Near Deployed/Stowed Connecting Portion>

A branch circuit installed near a deployed/stowed connecting portion (the deployment mechanisms 51 and 52 in the example of FIG. 1) which connects the adjacent antenna panels 31 to 33 will be described.

In a deployable planar antenna, the two divided circuits constituting the parallel feed circuit may be preferably provided at a middle point of a gap between the adjacent antenna panels 31 to 33 due to the equal length condition. However, since a waveguide connecting portion (the waveguide connecting portions 211 and 212 in the example of FIG. 2) which supplies high-frequency signals to the waveguides facing each other in a non-contact manner is located at the middle point, it may be difficult to install the branch circuit at the same position as the middle point due to physical interference.

Therefore, in the feeding circuit 301 according to the embodiment, the arrangement of such branch circuits is devised.

As a specific example, the branch circuit 311 in the feeding circuit 301 shown in FIG. 2 will be described.

An ideal position of the input terminal of the branch circuit 311 is a position of a middle point Q1 between the antenna panel 31 and the antenna panel 32.

However, since such an arrangement is difficult, in the embodiment, the input terminal of the branch circuit 311 is installed at a position of the point P2 which is a predetermined position. Here, the position of the point P2 is away from the position of the middle point Q1 to the left by a predetermined distance (or substantially the predetermined distance) in the Z-axis direction. The predetermined distance is $\{p\times(\lambda_{go}/2)\}$. p indicates a natural number (1, 2, 3, . . . ). $(\lambda_{go})$ indicates a guide wavelength (a wavelength inside the waveguide) at a center frequency of the high-frequency signal which is supplied.

In this way, an effect in which a difference between the electrical lengths to each of the antenna elements is reduced and a phase difference of the high-frequency signals to each of the antenna elements is reduced over a wide frequency band can be obtained by setting a distance between the position of the point P2 and the position of the middle point Q1 in the Z-axis direction to a multiple of a natural number of $(\lambda_{go}/2)$.

A position of the right output terminal of the branch circuit 221 is installed at a position on the side of the point P2 in accordance with the position of the input terminal of the branch circuit 311.

Further, the branch circuit 312 in the feeding circuit 301 shown in FIG. 2 will be described. The branch circuit 312 is also the same as the branch circuit 311.

That is, an ideal position of the input terminal of the branch circuit 312 is a position of a middle point Q2 between the antenna panel 31 and the antenna panel 33.

However, since such an arrangement is difficult, in the embodiment, the input terminal of the branch circuit 312 is installed at the point P3 which is a predetermined position. Here, the point P3 is away from the middle point Q2 to the right by a predetermined distance (or substantially the predetermined distance) in the Z-axis direction. The predetermined distance is $\{p\times(\lambda_{go}/2)\}$. Therefore, the same effect as that described for the branch circuit 311 can be obtained for the branch circuit 312.

A position of the left output terminal of the branch circuit 221 is installed at a position on the side of the point P3 in accordance with the position of the input terminal of the branch circuit 312.

As described above, it is possible to reduce the difference between the high-frequency phases to the antenna panels 31 to 33 over a wide frequency band by installing the branch circuit at a point away from a middle point of a deployment portion by $\{p\times(\lambda_{go}/2)\}$. Since a difference in a path length between two paths branched by the branch circuit due to the position of the branch circuit is $(p\times\lambda_{go})$, there is no difference in the high-frequency phase to the antenna panels 31 to 33 at the center frequency. When it is assumed that a difference between the center frequency and a waveguide wavelength at a band edge is $\Delta\lambda_g$, a phase difference of $\{\pm 2\pi p\times\Delta\lambda_g/\lambda_{go}\}$ is generated at both band edges for the two paths.

When the feeding circuit has a plurality of deployment portions, it is necessary to consider the number of times that paths through which a high-frequency signal is supplied to the antenna panels 31 to 33 pass through the deployment portions. When it is assumed that a difference between a maximum value and a minimum value of the number of times that the path passes through the deployment portion for each of the antenna panels is q, in the antenna panel which passes through the deployment portion a maximum number of times and is supplied with a high-frequency signal and an antenna panel which passes through the deployment portion a minimum number of times and is supplied with a high-frequency signal, a phase difference of $\{\pm 2\pi pq \times \Delta\lambda_g/\lambda_{go}\}$ is generated at both band edges. For example, it is possible to increase a band width of the feeding circuit including the deployment portion by arrangement in which both p and q are small.

As described above, in the antenna device 21 according to the embodiment, in the parallel feeding circuit to each of the antenna elements, the branch circuit is installed at a point away from a branch position, in which the electrical length to each of the antenna elements is equalized, by a predetermined distance $\{p \times (\lambda_{go}/2)\}$.

In the antenna device 21 according to the embodiment, in the deployable array antenna, it is possible to prevent a branch point from interfering with the deployment connecting portion while broadband characteristics are maintained.

As described above, in the antenna device 21 according to the embodiment, in the deployable antenna device, it is possible to effectively avoid the interference between the connecting portion of the deployable antenna panel and the branch circuit and thus to achieve high efficiency.

Additionally, in the antenna device 21 according to the embodiment, an antenna device having a small volume in the stowed condition and low cost can be realized.

<Constitution Example>

As a constitution example, an antenna device (the antenna device 21 in the example of FIG. 2) includes a plurality of deployable antenna panels including at least a first antenna panel (for example, the antenna panel 31 in the example of FIG. 2) and a second antenna panel (for example, the antenna panel 32 or the antenna panel 33 in the example of FIG. 2) adjacent to each other. The first antenna panel and the second antenna panel are connected to be deployable and stowable using a choke flange. A position at which the high-frequency signal is divided into a first path in the first antenna panel and a second path in the second antenna panel is a position (a position of the middle point Q1 or a position of the middle point Q2 in the example of FIG. 2) at a predetermined distance from a middle point between the first antenna panel and the second antenna panel in a direction in which the first antenna panel and the second antenna panel are arranged (a position divided by the branch circuit 311 or the branch circuit 312 in the example of FIG. 2). The predetermined distance is a distance based on a first value corresponding to {(a natural number)×(a wavelength corresponding to a center frequency of the high-frequency signal)/2}.

As one constitution example, in the antenna device, when the phase shift of the high-frequency signal does not occur, the predetermined distance is a first value, and when the phase shift of the high-frequency signal occurs, the predetermined distance is a value obtained by adjusting the first value to compensate for the phase shift.

As one constitution example, in the antenna device, each of the first path and the second path are a path using a waveguide. The wavelength is a guide wavelength inside the waveguide.

[Waveguide τ-Type Branch Circuit]

As the branch circuits 221, 311 and 312 shown in FIG. 2, a one-input two-output waveguide τ-type branch circuit is preferably used. Generally, when a coaxial cable or a plane micro-strip line is used as a transmission line of a passive array antenna, a τ-type branch circuit or the like is used. In particular, when a waveguide having small loss in a high frequency region is used as the transmission line, the one-input two-output waveguide τ-type branch circuit or the like is used.

Figure 17:
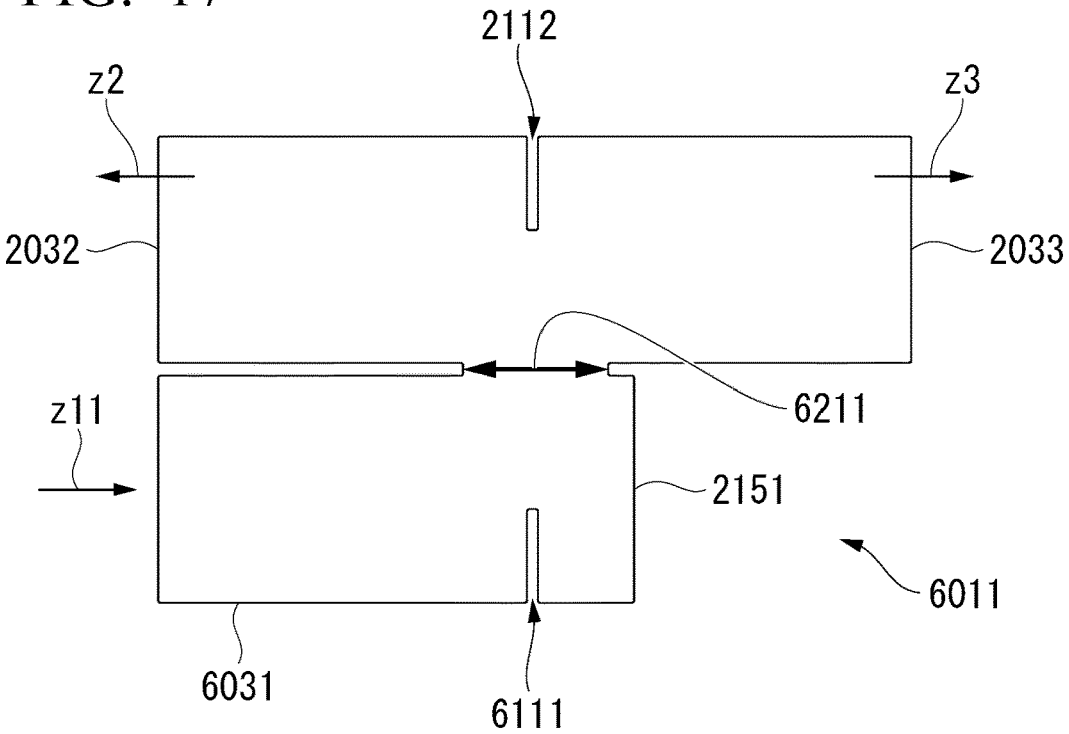
FIG. 17 is a diagram showing a configuration example of a waveguide τ-type branch circuit according to a conventional example.

FIG. 17 is a diagram showing a constitution example of a waveguide τ-type branch circuit 6011 according to a conventional example.

The waveguide τ-type branch circuit 6011 includes one input side waveguide 6031 and two output side waveguides 2032 and 2033.

The input side waveguide 6031 and the output side waveguides 2032 and 2033 are coupled via a coupling window 6211. A width of the coupling window 6211 is about half a wavelength.

An inductive wall 6111 with respect to a short-circuit wall 2151 is provided in the input side waveguide 6031.

An inductive wall 2112 is provided in the output side waveguides 2032 and 2033. In the waveguide τ-type branch circuit 6011, the input side waveguide 6031 has an input z11, the output side waveguide 2032 has an output z2, and the output side waveguide 2033 has an output z3.

Here, a distance between the inductive wall 6111 and the short-circuit wall 2151 is about a ¼ wavelength. A distance between planes including surfaces of these walls is used, that is, a separation distance in a direction perpendicular to the surfaces of these walls is used as the distance.

In such a waveguide τ-type branch circuit 6011, the input side waveguide 6031 has the short-circuit wall 2151 near the coupling window 6211. One inductive wall 6111 is provided in the input side waveguide 6031 to cancel reflection due to the short-circuit wall 2151. One inductive wall 2112 is installed in the output side waveguides 2032 and 2033 to adjust a branch ratio of two outputs. In such a waveguide τ-type branch circuit 6011, a frequency bandwidth is narrow due to a resonance phenomenon between the short-circuit wall 2151 on the input side and one inductive wall 6111. In particular, when the coupling slots for feeding a signal to the antenna elements are placed close to the output side waveguides 2032 and 2033, such a phenomenon is remarkable.

In the embodiment, a bandwidth of the waveguide τ-type branch circuit is increased in the passive array antenna using the waveguide in the feeding circuit. In particular, even when the coupling slot for feeding a signal to the antenna element is placed close to the output side waveguides, the wide bandwidth waveguide τ-type branch circuit is realized.

The main reason of a narrow frequency bandwidth in the waveguide τ-type branch circuit 6011 according to the conventional example is because there is one inductive wall 6111 which cancels the reflection from the short-circuit wall 2151 of the waveguide 6031 on the input side and it is limited to a bandwidth of the resonance phenomenon due to the combination of the short-circuit wall 2151 and the inductive wall 6111.

Therefore, in the embodiment, since another inductive wall (also referred to as a second inductive wall for convenience of description) is installed at a position of about ½ wavelength from the first inductive wall for the purpose of canceling the reflection from the short-circuit wall and the inductive wall according to the conventional example (also referred to as a first inductive wall for convenience of description), a pair of inductive walls are provided. Also, a width of the coupling window is optimized to about 0.6 wavelength.

Figure 10:
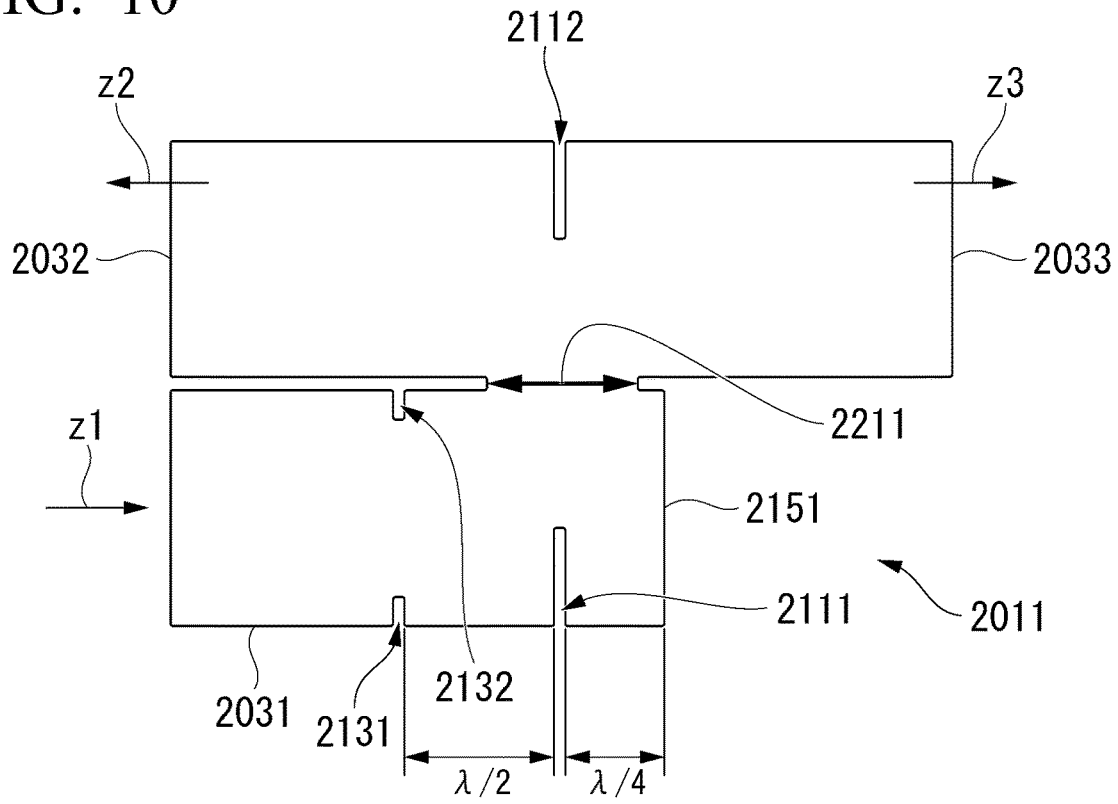
FIG. 10 is a diagram showing a configuration example of a waveguide τ-type branch circuit according to an embodiment of the present invention.

FIG. 10 is a diagram showing a constitution example of a waveguide τ-type branch circuit 2011 according to an embodiment of the present invention.

For convenience of description, the same components as those of the waveguide τ-type branch circuit 6011 shown in FIG. 17 will be described with the same reference numerals.

The waveguide τ-type branch circuit 2011 includes one input side waveguide 2031 and two output side waveguides 2032 and 2033.

The input side waveguide 2031 and the output side waveguides 2032 and 2033 are coupled via a coupling window 2211. A width of the coupling window 2211 is about 0.6 wavelength (=about 0.6 times the wavelength).

A first inductive wall 2111 and two second inductive walls 2131 and 2132 with respect to the short-circuit wall 2151 is provided in the input side waveguide 2031. The two second inductive walls 2131 and 2132 are installed to face each other in a direction in which these walls protrude.

An inductive wall 2112 is provided in the output side waveguides 2032 and 2033.

In the waveguide τ-type branch circuit 2011, the input side waveguide 2031 has an input z1, the output side waveguide 2032 has an output z2, and the output side waveguide 2033 has an output z3.

Here, the short-circuit wall 2151 is perpendicular (or substantially perpendicular) to the coupling window 2211.

Further, the first inductive wall 2111 and the second inductive walls 2131 and 2132 are respectively parallel (or substantially parallel) to the short-circuit wall 2151.

Further, a distance between the first inductive wall 2111 and the second inductive wall 2131 and 2132 is about ½ wavelength. A distance between planes including surfaces of these walls is used, that is, a separation distance in a direction perpendicular to the surfaces of these walls is used as the distance.

In the embodiment, double resonance is realized by a combination of the short-circuit wall 2151 and the first inductive wall 2111 and a combination of the first inductive wall 2111 and the second inductive walls 2131 and 2132. As described above, a plurality of sets of inductive walls are provided in the waveguide τ-type branch circuit according to the embodiment.

Figure 11:
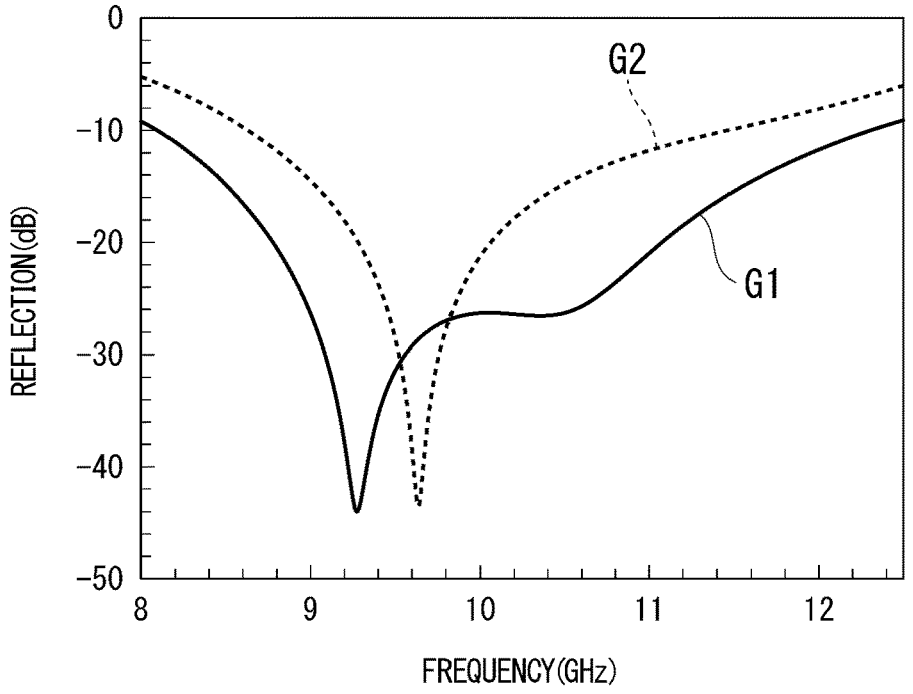
FIG. 11 is a diagram showing an example of reflection characteristics from the input side of the waveguide τ-type branch circuit by electromagnetic field analysis.

FIG. 11 is a diagram showing an example of reflection characteristics from the input side of the waveguide τ-type branch circuit by electromagnetic field analysis. The reflection characteristics are simulation results of a τ-type branch circuit designed and prototyped for a WR-90 waveguide.

In a graph shown in FIG. 11, a horizontal axis represents a frequency (GHz), and a vertical axis represents reflection (dB).

Further, the graph also shows a characteristic G1 of the waveguide τ-type branch circuit 2011 according to the embodiment and a characteristic G2 of the waveguide τ-type branch circuit 6011 according to the conventional example. This corresponds to single resonance.

As shown in FIG. 11, the characteristic G1 of the waveguide τ-type branch circuit 2011 according to the embodiment has a wider bandwidth than the characteristic G2 of the waveguide τ-type branch circuit 6011 according to the conventional example. This corresponds to the double resonance.

Here, in the embodiment, although the second inductive walls 2131 and 2132 are provided with respect to the first inductive wall 2111 to realize the double resonance, third and subsequent waveguides may be further provided at intervals of about ½ wavelength which is the same separation distance. That is, multiple resonance equal to or more than triple resonance may be used.

As described above, in the antenna device 21 according to the embodiment, in the waveguide τ-type branch circuit, the pair of the second inductive walls are installed at a position of about ½ wavelength from the first inductive wall.

The waveguide τ-type branch circuit according to the embodiment has one input and two outputs using the waveguides 2031 to 2033 and includes a plurality of sets of inductive walls for suppressing reflection by the short-circuit wall 2151. Thus, in the waveguide τ branch circuit, a plurality of resonance states are realized, and the frequency bandwidth is expanded.

In the antenna device 21 according to the embodiment, the broadband of the waveguide τ-type branch circuit can be achieved.

As described above, in the antenna device 21 according to the embodiment, in the deployable antenna device, broadband of the waveguide τ-type branch circuit can be realized.

Additionally, in the antenna device 21 according to the embodiment, it is possible to realize an antenna device having a small volume in the stowed condition and low cost.

<Constitution Example>

As one configuration example, the antenna device includes a waveguide τ-type branch circuit (the waveguide τ-type branch circuit 2011 in the example of FIG. 10).

In the waveguide τ-type branch circuit, two or more inductive walls (the first inductive wall 2111 and the pair of second inductive walls 2131 and 2132 in the example of FIG. 10) are provided about every ½ wavelength from a place of about a ¼ wavelength from the short-circuit wall (the short-circuit wall 2151 in the example of FIG. 10).

[Transmission Characteristics of Choke Flange]

Non-contact waveguide facing feeding is preferably used for the deployment mechanisms 51 and 52 in FIG. 1 and the waveguide connecting portions 211 and 212 in FIG. 2.

That is, when a coaxial cable or a plane micro-strip line is used as a transmission line, a flexible coaxial cable or micro-strip line is used in the feeding circuit of the deployment connecting portion of the deployable array antenna. When a waveguide with small loss at a high frequency is used as the transmission line, it has been proposed to use a non-contact waveguide facing feeding in which a choke flange and a flat cover flange face each other in a non-contact manner at a portion in which the feeding circuit straddles the deployment connecting portion.

The choke flange of the waveguide has a groove (a choke) having a depth of a ¼ wavelength at a position of ¼ wavelength from an opening of the waveguide to suppress harmful transmission loss and reflection even when there is a gap between flange surfaces of the waveguide or even when there is a fault in electrical conduction.

In a TE10 mode which is a propagation mode of a rectangular waveguide, power density near a center point of a long side in a cross section of the waveguide is high, and power density near a short side is low. Thus, the choke groove is provided in parallel in the outside of the long side in the cross section of the waveguide, and the choke groove is provided very close to the short side outside the short side to reduce a size of the choke flange and to facilitate manufacture.

Furthermore, a circular choke groove which passes through a position of a ¼ wavelength from the center point of the long side of the rectangular waveguide is generally provided to facilitate manufacture, and in standards such as the MIL standard, a circular choke flange is adopted as a flange of a waveguide.

It has been reported that transmission loss of the circular choke flange used in the flange of the waveguide in such a standard becomes extremely large at a specific frequency, and a function of the choke flange is impaired.

Figure 18:
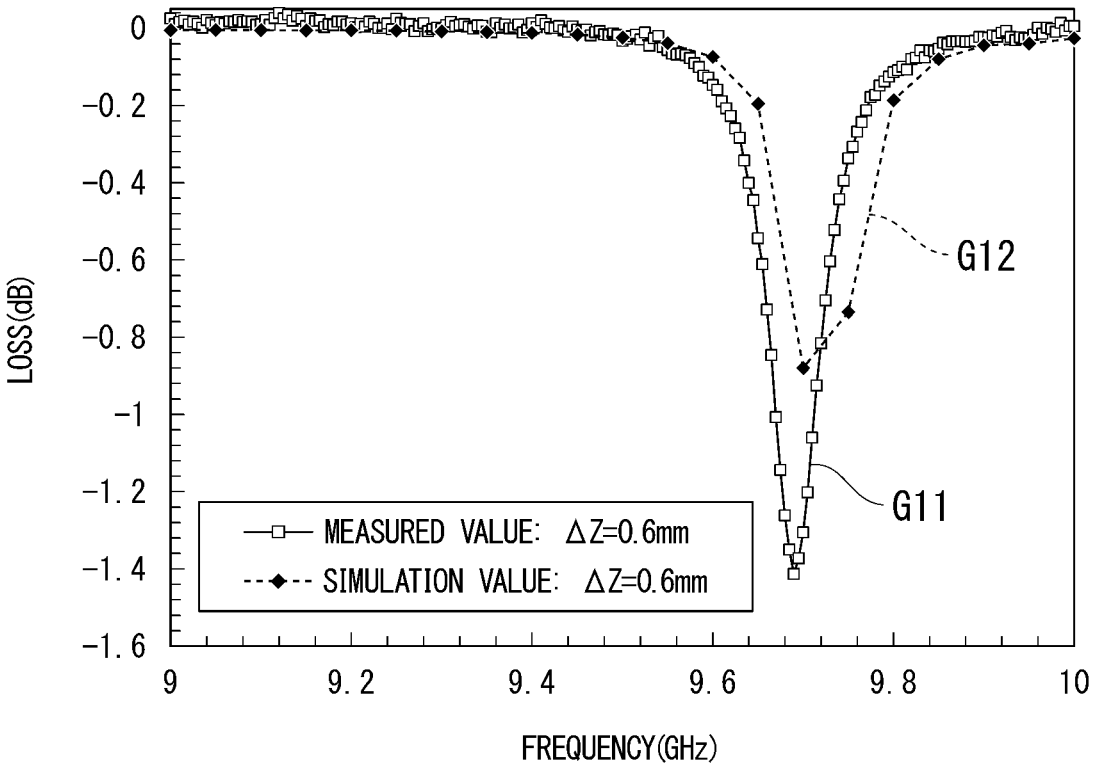
FIG. 18 is a diagram showing an example of a measured value of loss of a circular choke flange and a simulation result.

FIG. 18 is a diagram showing an example of a measured value and a simulation result of the loss of the circular choke flange. The simulation result was obtained by a computer.

The waveguides are installed with a gap to be shifted by ΔX in the X-axis direction, ΔY in the Y-axis direction, and ΔZ in the Z-axis direction from a connection position at which the regular waveguides are in close contact with each other using a rectangular waveguide WR-90 (8.20 to 12.5 GHz, aperture 22.86×10.16 mm) with a standard rectangular flange (SQUARE FLANGE CHOKE, CBR100) having a choke groove, and a waveguide of the same standard with a flat rectangular flange (SQUARE FLANGE PLAIN, UBR100). In the embodiment, a long side direction of the rectangular waveguide is defined as a direction parallel to the X axis, a short side direction of the waveguide is defined as a direction parallel to the Y axis, and a propagation direction of the waveguide is defined as a direction parallel to the Z axis.

In the graph shown in FIG. 18, a horizontal axis represents a frequency (GHz), and a vertical axis represents a loss (dB) of passing loss.

In the graph, the characteristic G11 is a value actually measured with ΔX=1 (mm), ΔY=0 (mm), and ΔZ=0.6 (mm). The characteristic G12 is a result obtained by simulation with ΔZ=0.6 (mm).

As shown in FIG. 18, the circular choke flange has a large resonant high-frequency loss.

In the embodiment, the transmission characteristics of the choke flange which is the feeding circuit of the deployment connecting portion are broadened in the deployable passive array antenna in which the waveguide is used in the feeding circuit.

The choke flange according to the embodiment will be described.

An electromagnetic field distribution in a gap region between the choke flange and the cover flange was analyzed by electromagnetic field simulator software to understand a phenomenon in which the transmission loss increases at a specific frequency for a standard circular choke flange and then find a solution. The result of the electromagnetic field simulation shows a result substantially coincident with the measured value and shows a loss due to a resonant gap at a specific frequency.

According to actual measurement, the transmission loss is almost zero in a wide frequency range, but the transmission loss increases by about 1 dB resonantly near a specific frequency depending on the gap ΔZ. This phenomenon has also been analyzed by the electromagnetic field simulation, and distribution of the intensity of a Z-direction electric field Ez in an X-Y plane at an intermediate distance of the flange gap was calculated.

<Description of a Simple Model>

The following simple model will be considered to understand the phenomenon.

In a region sandwiched between the groove of the choke flange and the cross section of the rectangular waveguide, a gap in the Z direction is sufficiently shorter than the wavelength, it is in a cutoff condition in the Z direction, and thus there is a uniform electric field Ez in the Z direction.

Thus, it is approximately regarded as a TM mode in the Z direction. A wavelength of an electromagnetic field in a two-dimensional plane is a wavelength ? in vacuum.

The number of standing waves which occurs in the region between the groove of the circular choke flange and the cross section of the rectangular waveguide is an even number due to the symmetry of arrangement and is 2M.

In addition, a typical path length that makes one round around a region between the groove of the choke flange and the boundary of the cross section of the rectangular waveguide is represented by L.

In this case, Equation (1) is established.

$$M\times\lambda=L \qquad \text{Equation (1)}$$

When Equation (1) is satisfied, an electromagnetic field power density in the gap region increases resonantly, and the high-frequency loss leaking from the groove of the choke flange increases.

Here, an exact value of a path length L differs according to a shape and a value of M and can be obtained by the electromagnetic field simulation.

Since the groove of the choke flange is close to the rectangular cross section near the short side of the cross section of the rectangular waveguide, the path length (perimeter) L is approximated by a length which makes one round around a boundary of the cross section of the rectangular waveguide.

Equation (2) is established by a length A of the long side and a length B of the short side of the waveguide 131.

$$L=2(A+B) \qquad \text{Equation (2)}$$

In such an approximation, a resonance frequency fr is obtained by Equation (3).

$$fr/fc=2M(A/L) \qquad \text{Equation (3)}$$

Here, c represents a speed of light in vacuum. Also, fc is a cut-off frequency (fc=c/2A) of the rectangular waveguide.

For example, assuming a WR90 standard waveguide is used, A=22.86 (mm) and B=10.16 (mm). L/A=2.89. The cutoff frequency is fc=6.56 (GHz).

In approximate expressions of Equations (2) and (3), for M=2, fr/fc=1.38, and the resonance frequency is calculated as fr=9.08 (GHz). On the other hand, regarding the actually measured resonance frequency, for a change of ΔZ=0-1 (mm), the actually measured resonance frequency is fr=9.0 to 9.8 (GHz) for M=2, and thus it can be said that Equations (2) and (3) are relatively good approximate expressions.

An operating frequency range of the standard waveguide is substantially in a range of 1.25 fc to 1.87 fc. Thus, in the circular choke flange, a high-frequency loss due to a resonance mode of M=2 is present near fr=1.38fc in the operating frequency range, and this is a practical obstacle.

The high-frequency loss due to the gap between the choke flanges is caused by a two-dimensional resonance phenomenon in the region between the groove of the choke flange and the boundary of the cross section of the rectangular waveguide.

Thus, in the embodiment, it is considered that the resonance frequency is moved out of the range of the operating frequency of the standard rectangular waveguide by devising a shape of the groove of the choke flange.

Regarding a modified shape of the groove of the choke flange, a typical path length which makes one round around the region between the groove of the choke flange and the boundary of the cross section of the rectangular waveguide is designated by L'. It is assumed that L' is common for M=2 and 3.

Regarding such a shape of the groove of such a choke flange, a condition in which the frequencies of the resonance mode in M=2 and 3 are out of the operating frequency range of the rectangular waveguide is determined.

That is, Equation (4) is solved, and the condition is satisfied when Equation (5) is established.

$$fr/fc=2M(A/L'),$$

$$fr/fc \leq 1.25, (M=2)$$

$$fr/fc \geq 1.87, (M=3) \quad \text{Equation (4)}$$

$$L'/A \approx 3.20 \quad \text{Equation (5)}$$

In this way, it is possible to realize a choke flange in which resonance loss does not increase in substantially the entire operating frequency range of the standard rectangular waveguide by changing the groove (L/A=2.89) of the standard circular choke flange and finding the shape of the groove of the choke flange having a large path length in one round of L'/≈3.20 by the electromagnetic field simulation or an experiment.

<Structure of Waveguide Connecting Portion>

Figure 12:
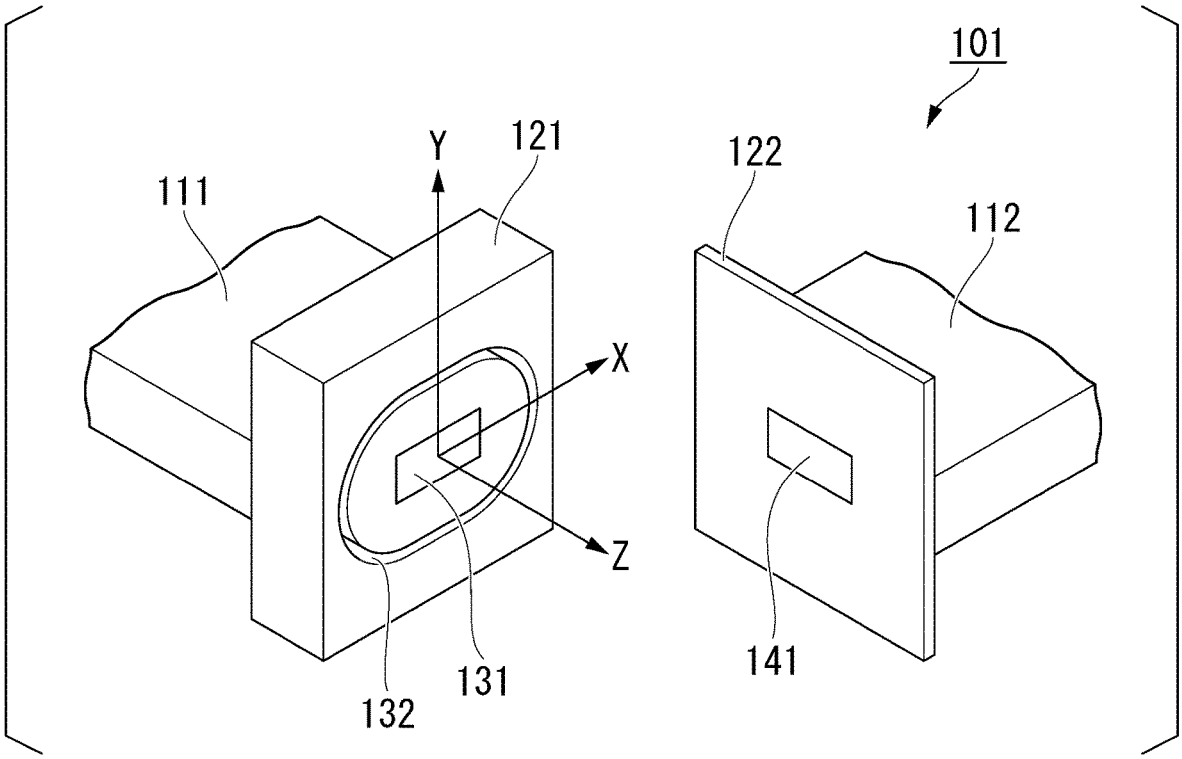
FIG. 12 is a diagram showing a schematic exterior of a waveguide connecting portion according to one embodiment of the present invention.

An example of a structure of a waveguide connecting portion 101 is shown with reference to FIG. 12.

FIG. 12 is a diagram showing a schematic exterior of the waveguide connecting portion 101 according to one embodiment of the present invention.

A rectangular waveguide 111, a choke flange 121 connected to the waveguide 111, a rectangular waveguide 112, and a cover flange 122 connected to the waveguide 112 are an example of the structure the waveguide connection portion 101.

The choke flange 121 includes a rectangular waveguide 131 corresponding to the waveguide 111. Further, the choke flange 121 includes a non-circular groove 132 which surrounds the waveguide 131 on a surface which faces the cover flange 122 (also, referred to as a "facing surface" for convenience of description).

With the center of the rectangular waveguide 131 as a reference, a direction parallel to the long side of the rectangle is defined as the X-axis direction, a direction parallel to the short side of the rectangle is defined as the Y-axis direction, and a direction perpendicular to the X-axis and the Y-axis is defined as the Z-axis direction.

The cover flange 122 has a rectangular waveguide 141 corresponding to the waveguide 112. In the cover flange 122, a surface which faces the choke flange 121 (also referred to as a "facing surface" for convenience of description) is flat.

In the embodiment, the waveguide 111 and the waveguide 112 can be connected by causing the facing surface of the choke flange 121 and the opposing surface of the cover flange 122 to face each other in a non-contact manner.

In the embodiment, the shape of the groove 132 is constituted by linear portions and semicircular portions. The upper and lower linear portions are parallel to the long side of the rectangular waveguide portion 131, and the semicircular portions are located on the right and left sides of these two linear portions. The left semicircular portion connects the two linear portions on the left, and the right semicircular portion connects the two linear portions on the right. The shape of the groove 132 may be called an egg shape or the like.

It is assumed that a length of one linear portion is 2d. Further, it is assumed that a length of the long side of the waveguide 131 is A, and a length of the short side is B.

A distance between the upper linear portion of the two linear portions and the upper long side of the waveguide 131 is ¼ wavelength, and similarly, a distance between the lower linear portion and the lower long side of the waveguide 131 is ¼ wavelength.

Figure 13:
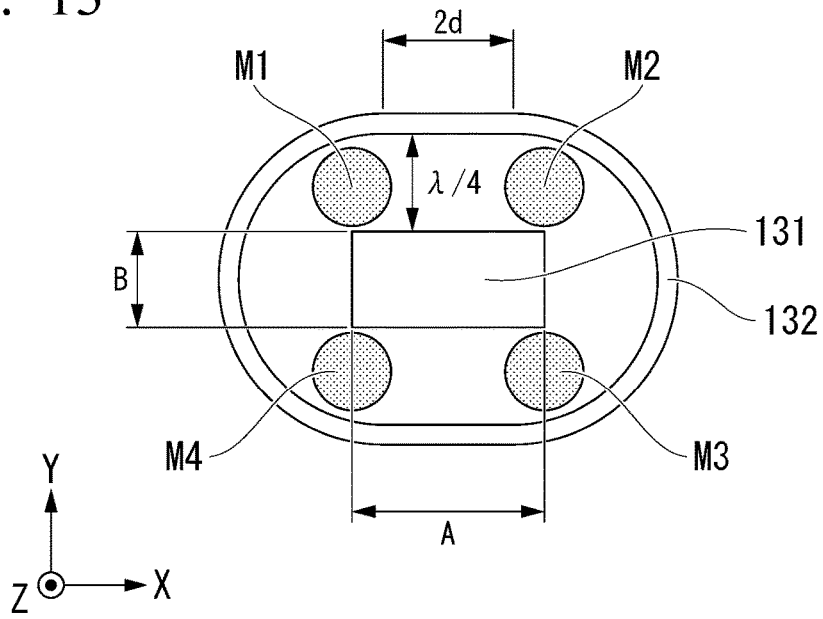
FIG. 13 is a diagram showing a mode 2A pattern in a choke flange according to one embodiment of the present invention.

FIG. 13 is a diagram showing an example of a mode 2A in the choke flange 121 according to one embodiment of the present invention.

In the exteriors of the waveguide 131 and the groove 132, positions M1 to M4 are positions M1 to M4 of maximum amplitudes of four standing waves when the standing waves of the mode 2A are excited.

Figure 14:
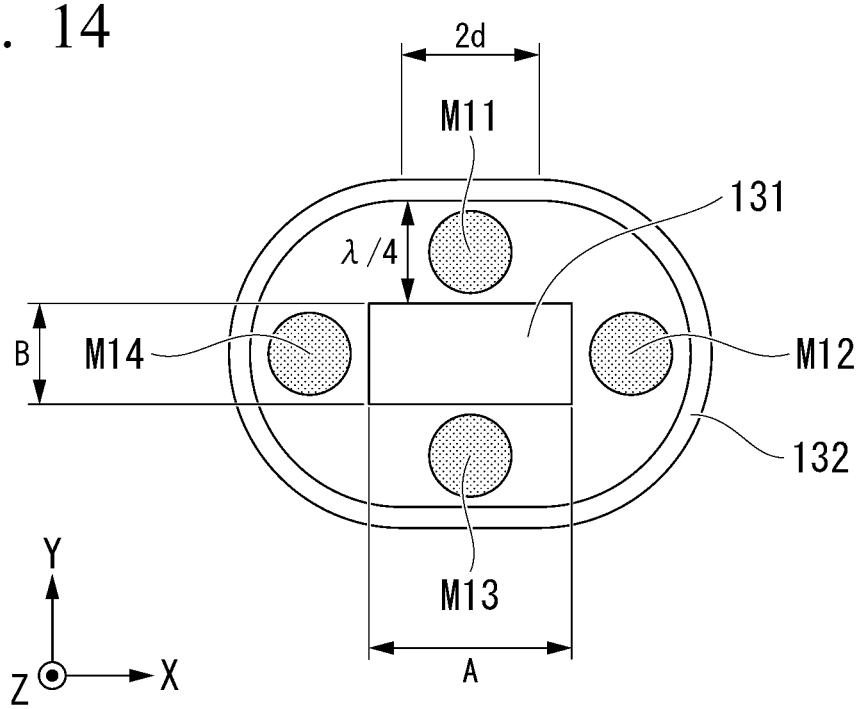
FIG. 14 is a diagram showing a mode 2B pattern in the choke flange according to one embodiment of the present invention.

FIG. 14 is a diagram showing an example of a mode 2B in the choke flange 121 according to one embodiment of the present invention.

In the exteriors of the waveguide 131 and the groove 132, positions M11 to M14 are positions M11 to M14 of maximum amplitudes of four standing waves when the standing waves of the mode 2B are excited.

Figure 15:
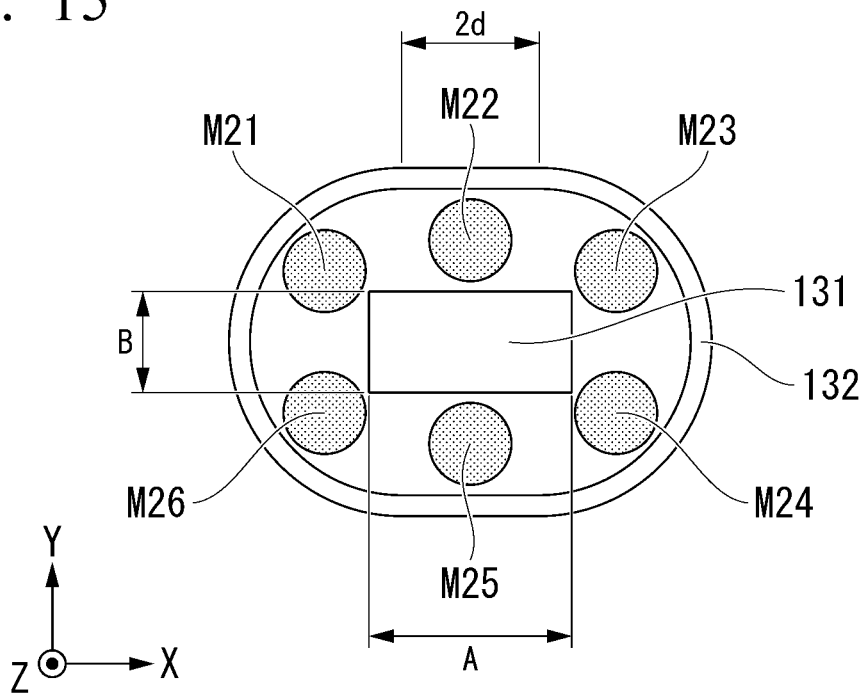
FIG. 15 is a diagram showing a mode 3A pattern in the choke flange according to one embodiment of the present invention.

FIG. 15 is a diagram showing an example of a mode 3A in the choke flange 121 according to one embodiment of the present invention.

In the exteriors of the waveguide 131 and the groove 132, positions M21 to M26 are positions M21 to M26 of maximum amplitudes of six standing waves when the standing waves of the mode 3A are excited.

Figure 16:
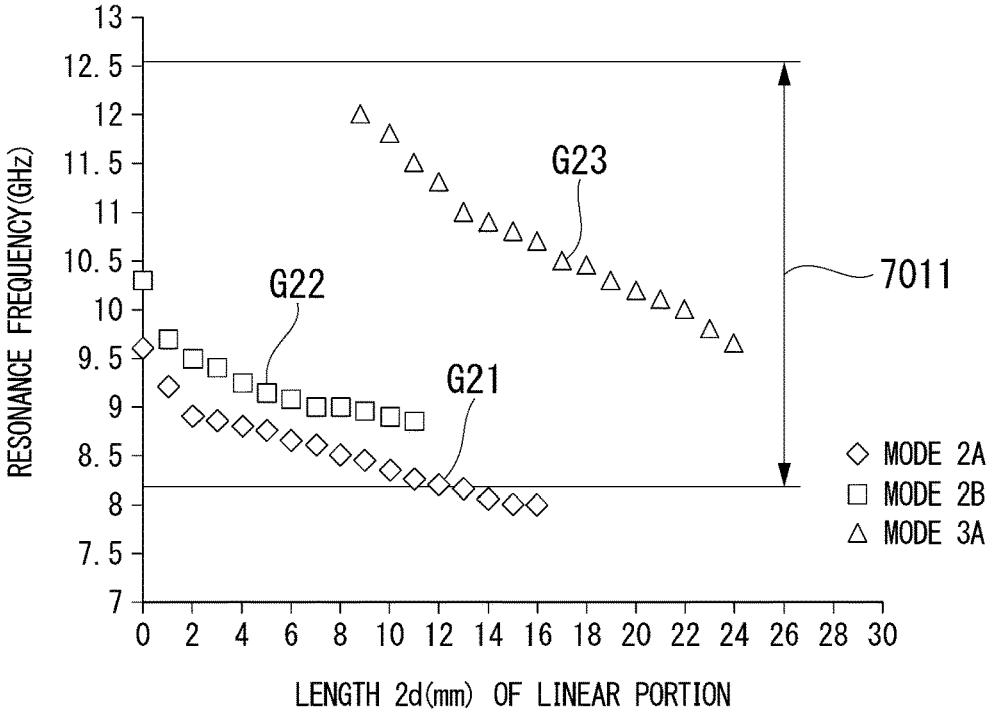
FIG. 16 is a diagram showing an example of a relationship between a length of a linear portion of a groove of the choke flange and a resonance frequency according to the embodiment.

FIG. 16 is a diagram showing an example of a relationship between the length (2d) of the linear portion of the groove 132 of the choke flange 121 and the resonance frequency according to the embodiment.

Also, a frequency range 7011 of the WR-90 waveguide is shown.

In the graph shown in FIG. 16, a horizontal axis represents the length (mm) of the linear portion of the groove 132, and a vertical axis represents the resonance frequency (GHz).

In addition, the graph shows a characteristic G21 when the mode 2A occurs, a characteristic G22 when the mode 2B occurs, and a characteristic G23 when the mode 3A occurs.

Here, the modes shown in FIGS. 13 to 15 will be described.

FIGS. 13 to 15 show positions of qualitative mode.

As shown in FIGS. 13 and 14, in a region between the groove 132 of the choke flange 121 and the cross section of the rectangular waveguide, the mode 2A and the mode 2B were respectively observed at different resonance frequencies. The mode 2A and the mode 2B are modes which have spatial standing waves having four Ez component peaks.

As described above, at frequencies in which propagation loss increases in resonance, the electromagnetic field which leaks into a flange gap region of the choke flange 121 does not have a one-dimensional behavior in a direction perpendicular to the cross section of the opening of the waveguide and is propagated two-dimensionally in the flange gap space between the groove 132 of the choke flange 121 and the cross section of the opening of the waveguide.

A frequency at which the resonance phenomenon occurs in the gap region between the groove 132 of the choke flange 121 and the cross section of the rectangular waveguide is roughly determined by a distance ΔZ of the flange gap and a two-dimensional shape between the groove 132 of the choke flange 121 and the cross section of the rectangular waveguide.

As one example, in the embodiment, the linear portion having a length of 2d is provided in a center portion of the long side in the cross section of the rectangular waveguide to be parallel to the long side of the waveguide, and both ends of the linear portion are connected to semicircular grooves having the same diameter as the groove of the standard circular choke flange.

As shown in FIG. 16, the frequency at which the high-frequency loss increases resonantly was obtained by changing the length 2d of the linear portion in the electromagnetic field simulation.

As shown in FIG. 16, as 2d increases, a region between the groove 132 of the choke flange 121 and the boundary of the cross section of the rectangular waveguide becomes larger, and thus the resonance frequency moves to the lower frequency side.

A frequency of the resonance mode in 2d=12 (mm) and M=2 is 8.2 (GHz) of the mode 2A, and the mode 2B is not excited. A frequency of the resonance mode 3A in M=3 is 11.3 (GHz). In a range of 2.9 (GHz) having a band width of 8.2 (GHz) to 11.3 (GHz), the resonance mode is not excited, and the high frequency loss due to the gap between the choke flanges is effectively suppressed by the groove 132 of the choke flange 121.

Actually, an egg-shaped choke flange of 2d=12 (mm) was manufactured. A center position of the axis of the waveguide was shifted by 0-1 (mm) with respect to an axis of the gap between the choke flanges, there was a shift of 0-1 (degree) regarding the angle shift, a distance of the gap between the choke flanges is 0-2 (mm), and the actually measured value of the loss due to the gap between the choke flanges was 0.2 (dB) or less in a wide frequency range of 2.5 (GHz) of 8.5 (GHz) to 11 (GHz).

From scaling of the electromagnetic field, generally, regarding a rectangular waveguide with a long side having a length A, in the shape of the egg-shaped choke having the linear portion of 2d=0.52A at the center portion of the long side, it is possible to suppress the resonance loss due to the gap between the choke flanges in 1.29<fr/fc<1.68 which is a standardized frequency region.

In the embodiment, high efficiency can be achieved using a state in which the standing waves of the modes 2A and 2B shown in FIGS. 13 and 14 are not excited and the standing waves of the mode 3A shown in FIG. 15 are not excited. That is, the high efficiency can be achieved by adopting the constitution in which the excitation of standing waves is suppressed.

As described above, in the antenna device 21 according to the embodiment, a choke flange in which the path length L that passes through a position of about ¼ wavelength from the opening of the waveguide in a region in which a propagation power density is large in an opening surface of the waveguide and makes one round of the region between the choke groove and the opening of the waveguide does not become an integral multiple of the wavelength in the operating frequency range of the waveguide is used.

In particular, in a standard rectangular waveguide, a choke flange in which a value (L/A) obtained by dividing the path length L that passes through a point of ¼ wavelength from the middle point of the long side of the rectangle and makes one round of the region between the choke groove and the opening of the waveguide by the length A of the long side of the rectangular waveguide is approximately 3.2 is used. The path length in question is identified by, for example, an electromagnetic field simulation.

In the embodiment, in the choke flange 121 having a groove (the groove 132 which is a portion of the choke groove), the choke flange 121 has a shape obtained by deforming a shape of the groove with respect to a circular shape so that an operating frequency is set with a frequency at which four standing waves are generated in a region bounded by the opening of the waveguide 111 and the groove and a frequency at which six standing waves were generated in the region as a lower and an upper limit, respectively.

In the antenna device 21 according to the embodiment, the bandwidth of the choke flange can be widened.

As described above, in the antenna device 21 according to the embodiment, in the deployable antenna device, it is possible to realize the wideband of the choke flange, and thus high efficiency can be achieved.

Additionally, in the antenna device 21 according to the embodiment, it is possible to realize an antenna device with a small volume in stowed condition and low cost.

<Constitution Example>

As one constitution example, the antenna device includes a choke flange (the choke flange 121 in the example of FIG. 12).

The choke flange includes a waveguide (the waveguide 131 in the example of FIG. 12) and a groove (the groove 132 in the example of FIG. 12). While a plane of the cross section of the choke flange (the plane parallel to the X-Y plane in the example of FIG. 12) is considered two-dimensionally, a dimension of the groove (for example, the length 2d of the linear portion in the example of FIG. 12) was set to suppress excitation of the standing wave between the waveguide and the groove (ideally, not to excite a standing wave).

(Another Example of Antenna Device)

An antenna device having another constitution will be described.

The antenna device includes two antenna panels, a feeding circuit including a high-frequency source circuit, and two deployed/stowed connecting portions. The feeding circuit is provided on the antenna panel or the like. The high-frequency source circuit is provided inside the satellite structure.

The antenna device uses a deployable antenna having a planar shape.

In the antenna device, the antenna panel is not provided on one surface of the satellite structure (for convenience of description, referred to as a surface W1 in this example).

A first antenna panel is provided on one side of the surface W1.

A second antenna panel is installed on the one side of the surface W1 in series with the first antenna panel.

Each of surfaces of the two antenna panels has the same shape (or substantially the same shape).

The surface W1 of the satellite structure and the surface of each of the antenna panels have the same shape (or substantially the same shape).

The first antenna panel is connected to the surface W1 of the satellite structure via a deployed/stowed connecting portion to be openable and closable. The deployed/stowed connecting portion has, for example, a hinge structure which can be deployed/stowed.

In a state in which the first antenna panel is deployed with respect to the surface W1, the surface of the first antenna panel and the surface W1 are parallel (or substantially parallel) and are located on the same plane (or substantially on the same plane).

On the other hand, in a state in which the first antenna panel is stowed with respect to the surface W1, the surface of the first antenna panel and one side surface of the satellite structure are parallel (or substantially parallel). The side surface is one of four surfaces adjacent to the surface of the first antenna panel among the surfaces of the satellite structure.

Similarly, the second antenna panel is connected to the surface W1 via a deployed/stowed connecting portion to be deployable/stowable. The deployed/stowed connecting portion has, for example, a hinge structure which can be deployed and stowed.

In a state in which the second antenna panel is deployed with respect to the first antenna panel, the surface of the second antenna panel and the surface of the first antenna panel are parallel (or substantially parallel) and are located on the same plane (or substantially on the same plane).

On the other hand, in a state in which the second antenna panel is stowed with respect to the first antenna panel, for example, the surface of the second antenna panel and the surface of the first antenna panel overlap each other.

Here, in a state in which the first antenna panel and the second antenna panel are stowed, the first antenna panel and the second antenna panel are stowed, and the artificial satellite becomes compact as a whole.

Further, in a state in which the first antenna panel or the second antenna panel is deployed, the surfaces of the two antenna panels are located in series on the same plane (or substantially on the same plane). Accordingly, an antenna constituted with two antenna panels is realized.

Also, in such an antenna device, for example, like the antenna device 21 shown in FIG. 1, a part or all of the technology according to the embodiment can be applied.

ABOUT ABOVE-DESCRIBED EMBODIMENT

Here, in the above-described embodiment, the case in which the antenna device is mounted in the artificial satellite has been exemplified, but the present invention is not limited thereto. The antenna device may be applied to any device, for example, a wireless communication device such as a mobile phone system or the like.

Also, in the above-described embodiment, although the constitution in which the high-frequency source circuit is included in the feeding circuit is shown, it may be considered that the feeding circuit does not include the high-frequency source circuit, that is, a constitution in which the feeding circuit and the high-frequency source circuit are provided separately may be used. In this case, it may be considered that the antenna device does not include the high-frequency source circuit, that is, a constitution in which the antenna device and the high-frequency source circuit are provided separately may be used.

Also, in the above-described embodiment, for convenience of description, although the arrangement of waveguides such as a branch circuit or a combining circuit has been described using words such as "input" and "output" according to the transmission direction of the high-frequency signal, when the transmission direction of the high-frequency signal is reversed, the "input" and the "output" are reversed. Thus, "dividing" and "combining" may be reversed.

For example, each of characteristic constitution of the antenna device 21 shown in the above-described embodiment may be individually implemented, or may be implemented in combination of two or more.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description and is only limited by the scope of the appended claims.

What is claimed is:

1. An antenna device comprising:

an antenna panel;

one input terminal through which a high-frequency signal is input; and a feeding circuit which distributes the high-frequency signal input to the input terminal to a plurality of antenna elements provided on the antenna panel, wherein the feeding circuit includes: at least one first-stage branch circuit which includes one input and two outputs; at least two second-stage branch circuits which receive outputs of the first-stage branch circuit and include one input and two outputs; and a combining circuit which includes two inputs and one output and receives two outputs selected from the outputs of the first-stage branch circuit and outputs of the second-stage branch circuit, and wherein the combining circuit is a linear circuit and only outputs the linear sum of the two inputs signals.

2. The antenna device according to claim 1, wherein the combining circuit is installed at least at a center in a direction in which the plurality of antenna elements are arranged.

3. The antenna device according to claim 1, wherein:

the antenna panel includes at least a first antenna panel and a second antenna panel adjacent to each other, each of a first path in the first antenna panel and a second path in the second antenna panel is a path using a waveguide, the first antenna panel and the second antenna panel are connected to be deployable and stowable using a choke flange and a cover flange, a position at which the high-frequency signal is divided into the first path in the first antenna panel and the second path in the second antenna panel is a position at a predetermined distance from a middle point of a feed point between the first antenna panel and the second antenna panel in a direction in which the first antenna panel and the second antenna panel are arranged, and the predetermined distance is a distance based on a first value corresponding to {(a natural number)×(a wavelength corresponding to a center frequency of the high-frequency signal)/2}.

4. The antenna device according to claim 3, wherein the wavelength is a guide wavelength of the waveguide.

5. The antenna device according to claim 4, wherein:

the first-stage branch circuit or the second-stage branch circuit is a waveguide τ-type branch circuit which includes one input and two outputs and uses the waveguide, and in the waveguide τ-type branch circuit, a plurality of sets of inductive walls for suppressing reflection by a short-circuit wall are provided.

6. The antenna device according to claim 4, wherein:

the choke flange including a groove is provided in the waveguide, and the choke flange has a shape obtained by deforming a shape of the groove with respect to a circular shape so that an operating frequency is set with a frequency at which four standing waves are excited in a region bounded by an opening portion of the waveguide and an opening surface of the cover flange which faces the groove and a frequency at which six standing waves are excited in the region as a lower limit and an upper limit, respectively.

* * * * *